US010799781B1

(12) United States Patent
Means et al.

(10) Patent No.: US 10,799,781 B1
(45) Date of Patent: Oct. 13, 2020

(54) GOLF SWING PLAYING AID DEVICE

(71) Applicant: Swing Memory Xccelerator LLC, Shaker Heights, OH (US)

(72) Inventors: Robert P. Means, Shaker Heights, OH (US); Curt Geideman, Grafton, OH (US); Thomas Hayes, Lakewood, OH (US)

(73) Assignee: Swing Memory Xccelerator, LLC, Shaker Heights, OH (US)

( * ) Notice: Subject to any disclaimer, the term of this patent is extended or adjusted under 35 U.S.C. 154(b) by 0 days.

(21) Appl. No.: 16/585,071

(22) Filed: Sep. 27, 2019

Related U.S. Application Data

(60) Provisional application No. 62/738,169, filed on Sep. 28, 2018.

(51) Int. Cl.

| | |
|---|---|
| ***A63B 69/36*** | (2006.01) |
| ***A63B 53/14*** | (2015.01) |
| ***A63B 71/06*** | (2006.01) |

(52) U.S. Cl.
CPC ..... *A63B 69/3632* (2013.01); *A63B 71/0622* (2013.01); *A63B 2071/0625* (2013.01); *A63B 2071/0655* (2013.01); *A63B 2071/0694* (2013.01); *A63B 2220/20* (2013.01); *A63B 2220/40* (2013.01); *A63B 2220/833* (2013.01); *A63B 2225/50* (2013.01)

(58) Field of Classification Search
CPC ..... A63B 69/3632; A63B 71/0622; A63B 2071/0655; A63B 2071/0625; A63B 2071/0694; A63B 2220/833; A63B 2220/40; A63B 2220/20; A63B 2225/50
USPC ..... 473/201–205, 226, 227
See application file for complete search history.

(56) References Cited

U.S. PATENT DOCUMENTS

| | | | | | |
|---|---|---|---|---|---|
| 715,225 | A | * | 12/1902 | Whitner | |
| 4,804,181 | A | * | 2/1989 | Foster | A63B 69/3632 473/206 |
| 4,981,297 | A | * | 1/1991 | Foster | A63B 53/14 473/206 |
| 5,042,811 | A | * | 8/1991 | D'Amico | A63B 53/14 473/206 |
| 5,509,809 | A | * | 4/1996 | Clay | A63B 69/3608 434/252 |
| 5,527,039 | A | | 6/1996 | Levesque | |
| 5,954,591 | A | | 9/1999 | Liberatore | |

(Continued)

*Primary Examiner* — Nini F Legesse
(74) *Attorney, Agent, or Firm* — Renner, Otto, Boisselle & Sklar, LLP

(57) ABSTRACT

A golf swing playing aid device for use on a conventional golf club having a handle, an impact head and a shaft. The golf swing playing aid device includes a grip member having an outer portion and an inner portion. The outer portion is adapted to be grasped by the lower hand of the user. The inner portion is configured to slide along the golf club shaft. The grip member is configured such that when gripped by the lower hand of the user during a backswing the grip member slides down the shaft toward the head, whereby the hands of the user, when grasping the handle with the upper hand and the grip member with the lower hand can separate progressively during a backswing and then progressively return back into proximity during a downswing and follow-through of a golf swing to promote a more perfect and repeatable golf swing.

20 Claims, 28 Drawing Sheets

(56) References Cited

U.S. PATENT DOCUMENTS

| | | | | |
|---|---|---|---|---|
| 6,540,621 | B1 * | 4/2003 | Robinson | A63B 53/14 473/201 |
| 6,612,936 | B1 * | 9/2003 | Matias | A63B 69/3638 473/256 |
| 6,923,727 | B1 | 8/2005 | Jacobs | |
| 6,991,554 | B2 | 1/2006 | Ryan | |
| 7,048,637 | B2 * | 5/2006 | McDonald | A63B 53/14 473/203 |
| 7,081,053 | B2 | 7/2006 | Kallassy | |
| 7,261,639 | B2 * | 8/2007 | Smith | A63B 53/14 473/206 |
| 7,297,078 | B2 | 11/2007 | Libonati | |
| 7,556,573 | B2 | 7/2009 | Beach | |
| 7,922,595 | B2 | 4/2011 | Libonati | |
| 8,540,584 | B1 | 9/2013 | Sorenson | |
| D733,235 | S * | 6/2015 | Smith | D21/753 |
| 9,687,718 | B1 | 6/2017 | Sorenson | |

* cited by examiner

GOLF SWING PLAYING AID DEVICE

RELATED APPLICATIONS

This application claims the benefit of U.S. Provisional Application No. 62/738,169 filed Sep. 28, 2018, which is hereby incorporated herein by reference in its entirety.

TECHNICAL FIELD

The present disclosure relates generally to golf, and more particularly to golf playing aids.

BACKGROUND

A golf swing can be viewed as comprising a backswing from a starting position to a top position and a downswing from the top position to a follow-through position. A ball-impacting position is crossed during the backswing at approximately its nadir. Consistently achieving a proper golf swing requires committing the mechanics of the backswing and the downswing to muscle memory so that they can be reliably repeated. For golfers at most every level of play, consistency and repeatability in achieving the desired optimal swing remains an ongoing challenge. Moreover, golfer's often do not engage in proper stretching of muscles to increase flexibility for increasing the speed of the swing.

The game of golf requires the use of a variety of different types of golf clubs, and hence the common presumption is that it requires different swings, including driving, pitching, chipping, and putting. Proper execution of the swing for each club requires the specific recollection and dynamic application of a separate sequence of steps, but they all do not need to be different. Most training aids that have been developed for the sport require the use of additional equipment that cannot be used during a regulation round of golf. More particularly, typical training aids do not provide a repeatable and consistent way of practicing both the long and short game (e.g., pitching and chipping) with a single device.

The hands, which are the golfer's connection to the golf club, are often overlooked as the primary source for the execution of any proper and repeatable golf swing. The positioning of the hands on the golf club, therefore, is important in the building of a proper and repeatable golf swing. Having improper hand position on the grip can inhibit speed and acceleration of the shaft during the swing, as well as reduce accuracy and consistency of the shot.

The short game of golf (i.e., less than 100 yards, particularly 50 yards or less) is arguably the most difficult part of the game, requires the greatest precision, and for the average golfer may constitute over 50% of the number of shots taken in a round of golf. However, golfers often do not adapt their game, and particularly their style of swing, for accommodating shorter shots (i.e., "chip shots," "pitch shots," or shots taken with an iron or wedge, for example) compared to longer shots (i.e., shots taken with a driving iron or driver, for example). In particular, even during chip shots or pitch shots (e.g., less than 30 yards) golfers may have a tendency to cock their wrists during their backswing, in a fashion similar to a standard long shot, which may cause problems with the consistency and accuracy. Moreover, golfer's often have problems assessing the proper distance of such short shots.

SUMMARY

The present disclosure provides a comprehensive golf swing playing aid device which effectively addresses a full range of elements for achieving a proper, repeatable golf swing and committing the mechanics of such a swing to muscle memory. More particularly, the golf swing playing aid can be used as part of one's golf club set while practicing or playing a regulation round of golf.

The golf swing playing aid device enables the average golfer to use the device as a playing aid during a regulation round of golf by removably attaching it to any of their own conventional golf clubs at the point-of-play. In particular, the golf playing aid device may promote a more perfect and repeatable swing for both the full and short-game by committing the mechanics of such a swing to muscle memory that is essentially the same for all golf shots. In addition, the device may promote the stretching of one's muscles to increase flexibility with the intent of increasing the speed at which one could swing the club. Furthermore, the device may be configured to be gripped by the golfer so that the average golfer positions their hands in such a fashion to accomplish a more accurate and repeatable golf swing. For example, the device may be configured with such features as to promote a throwing motion of the lower hand on the golf club during the downswing, which helps increase distance by increasing speed and acceleration, as well as accuracy.

The golf swing playing aid device may also include features for determining and indicating whether the golfer's wrist has cocked or hinged during the backswing, so as to alert the golfer of any wrist cock, in an effort to promote a non-wrist-cocking swing to muscle memory. Such a feature may be particularly advantageous during the short game for improving accuracy and consistency when taking chip shots, pitch shots, or the like.

In addition, the golf swing playing aid device may include features for determining, estimating, and indicating the distance of a shot. For example, the swing playing aid may have a device that measures the acceleration of the backswing and then calculates an estimated distance or range of distances of the shot by assuming, for example, that the downswing or through-swing is at the same acceleration as the backswing. Such a feature may be particularly advantageous for improving the golfer's short game by establishing a swing tempo for certain distance shots that may be committed to muscle memory.

According to an aspect of the present disclosure, a golf swing playing aid device for use on a golf club having a handle, an impact head and a shaft, includes a grip member removably securable to the shaft for grasping by a lower hand of the user, the grip member freely slidable longitudinally with respect to the shaft and configured such that, when gripped by the lower hand of the user during a backswing the grip member slides down the shaft toward the head, whereby the hands of the user, when grasping the handle and slidable grip member, can separate progressively during a backswing and then progressively return back into proximity during a downswing and follow-through of a golf swing to promote a proper and repeatable golf swing.

According to another aspect of the present disclosure, a golf swing playing aid device adapted for use on a conventional golf club having a handle, an impact head and a shaft, the golf swing playing aid device including: a grip member having an outer portion and an inner portion; the outer portion having a portion with a ball-shaped form that is adapted to be gripped like a ball in a lower hand, and more particularly the fingers of a user; and the inner portion being configured to slide along the shaft of the golf club; wherein the grip member is configured to be selectively removable from the shaft; and wherein the grip member is configured such that when gripped by the lower hand of the user during a backswing, the grip member slides down the shaft toward the head, whereby the lower hand and an upper hand of the user, when grasping the handle with the upper hand and the grip member with the lower hand, can separate progressively during a backswing and then progressively return back into proximity during a downswing and follow-through of a golf swing; and wherein the ball-shaped form of the outer portion enables the user to conceptualize throwing the grip member as a ball toward a golf ball on the ground during the downswing to thereby promote ingraining a higher quality and more repeatable golf swing into muscle memory.

According to another aspect of the present disclosure, a golf swing playing aid device for use on a golf club having a handle, an impact head and a shaft, the golf swing playing aid device including: a grip member having an outer portion and an inner portion; the outer portion being adapted for being grasped in a lower hand, and more particularly the fingers of a user; and the inner portion being configured to slide along the shaft of the golf club; wherein the grip member is configured to be selectively removable from the shaft; wherein the grip member is configured such that when gripped by a lower hand of the user during a backswing, the grip member slides down the shaft toward the head, whereby the lower hand and an upper hand of the user, when grasping the handle with the upper hand and the grip member with the lower hand, can separate progressively during a backswing and then progressively return back into proximity during a downswing and follow-through of a golf swing; and wherein at least one of the inner portion and the outer portion is made of a rigid material that resists deformation when acted upon by a force exerted by the user during the golf swing to thereby facilitate a sliding motion of the grip member along the shaft.

According to another aspect of the present disclosure, a golf swing playing aid device for use on a golf club having a handle, an impact head and a shaft, the golf swing playing aid device including: a grip member having an outer portion and an inner portion; the outer portion being adapted for being grasped in a lower hand, and more particularly the fingers of a user; and the inner portion being configured to slide along the shaft of the golf club; wherein the grip member is configured to be selectively removable from the shaft; wherein the grip member is configured such that when gripped by a lower hand of the user during a backswing, the grip member slides down the shaft toward the head, whereby the lower hand and an upper hand of the user, when grasping the handle with the upper hand and the grip member with the lower hand, can separate progressively during a backswing and then progressively return back into proximity during a downswing and follow-through of a golf swing; and wherein the device includes a locking mechanism that is configured to grippingly engage the handle of the golf club in such a way to self-support the grip member on the golf club.

According to another aspect of the present disclosure, a golf playing aid includes an electronic device for determining and indicating whether the golfer's wrist has cocked during the backswing, so as to alert the golfer via audible, visual, and/or tactile means of such wrist cock in an effort to prevent the golfer from cocking their wrist and thereby committing the mechanics of such a non-wrist-cocking swing to muscle memory.

In some embodiments, the electronic device includes a gyroscope configured for measuring rotation of the device about one or more axes and for communicating signals to a processor for determining whether the measured rotation has reached or exceeded a threshold level.

According to another aspect of the present disclosure, a golf playing aid includes an electronic device for determining, estimating, and indicating the distance of a shot, so as to alert the golfer via audible, visual, and/or tactile means that the distance of the shot may be achieved.

In some embodiments, the electronic device may include an accelerometer configured for measuring acceleration of the device along one or more axes and for communicating signals to a processor for determining whether the measured acceleration has reached or exceeded a threshold level.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

DRAWINGS

The annexed drawings, which are not necessarily to scale, show various aspects of the invention in which similar reference numerals are used to indicate the same or similar parts in the various views.

DETAILED DESCRIPTION

Figure 2:
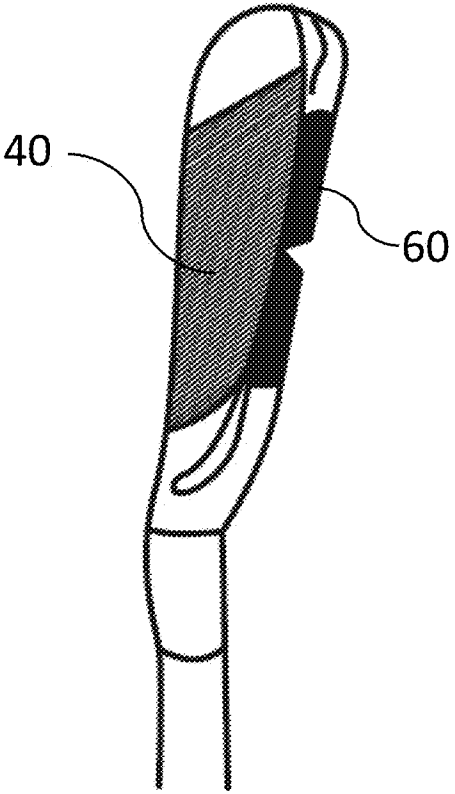
FIG. 2 shows an exemplary decal for use in combination with the playing aid device.

The principles of the present disclosure have particular application to golf swing playing aids and thus will be described below chiefly in this context. It is also understood that principles and aspects of the present disclosure may be applicable to other playing or training aids where it is desirable to provide a proper swing and committing the mechanics of such a swing to muscle memory. In addition, in the discussion above and to follow, the terms "upper", "lower", "top", "bottom," "end," "inner," "left," "right," "above," "below," etc. typically refer to the golf swing playing aid when it is properly attached to a golf club in the upright position, as shown in the drawings. This is done realizing that the playing aid device may be oriented in various positions during use. Furthermore, in the discussion above and to follow, reference may be made to using the device by right-handed or left-handed users, which is done realizing that the playing aid device may be configured for use by both right-handed and left-handed users.

Figure 1:
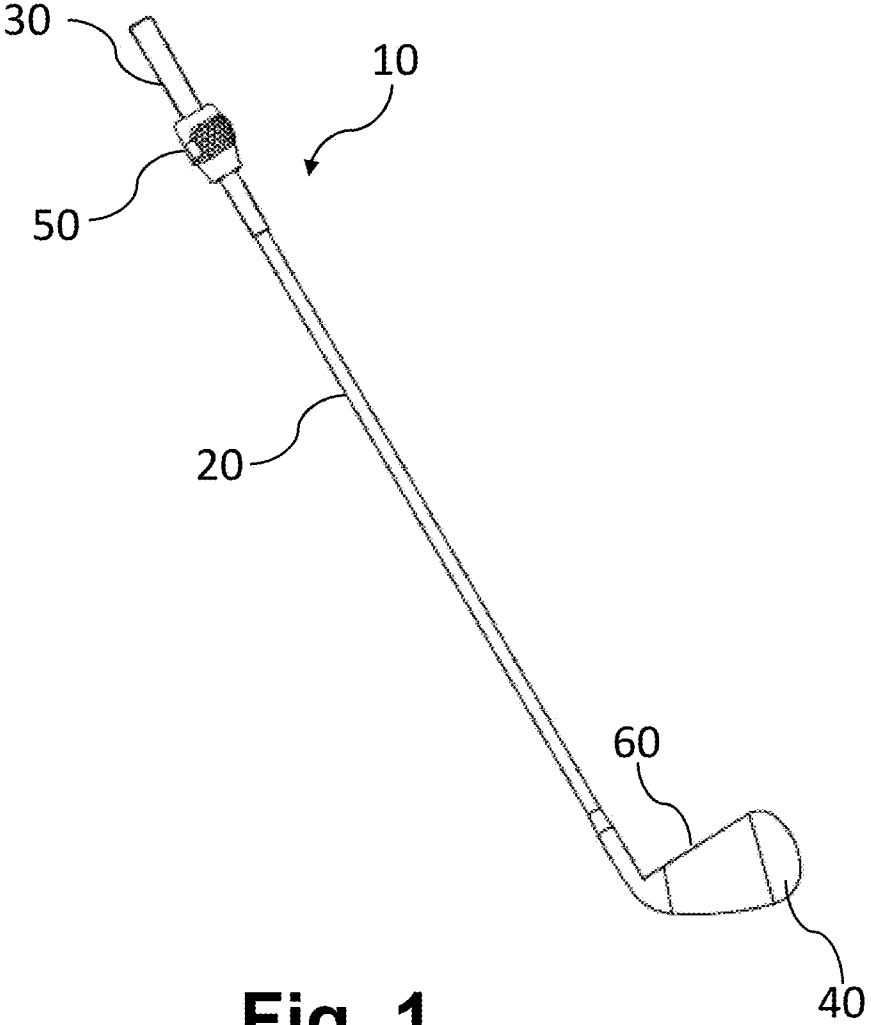
FIG. 1 shows a golf club including an exemplary golf swing playing aid device according to an embodiment of the present disclosure.

Turning now to the drawings, and initially to FIG. 1, an exemplary golf swing playing aid device 50 in the form of a slidable grip member (also referred to with reference number 50) is shown. In the illustrated embodiment, the slidable grip member 50 is slidably positioned on a golf club 10. The golf club 10 can comprise an elongated shaft 20, a handle 30 at one end of the shaft 20, a head 40 at the shaft's other end, and a slidable grip member 50. The slidable grip member 50 is slidably positioned on the shaft 20 so that it can slide from the handle 30 towards the head 40. The golf club 10 (minus the slidable grip member 50) is preferably a conventional golf club, whereby suitable candidates could be the irons, hybrids, and woods found in a standard set of golf clubs. In other words, the slidable grip member 50 can be added to any regulation USGA approved golf iron or wood; or any other suitable conventional club for playing golf.

Referring to FIG. 2, the golf club 10 can additionally or alternatively include decals 60. The decals 60 are located on the head 40 (e.g., irons, hybrids, woods) and help maintain proper club head angle relative to the golf ball in the backswing, downswing, and/or through the impact position. The decals 60 are designed to create a visual image of the proper golf swing path which the player commits to memory.

The slidable grip member 50 can have any suitable shape with an outer surface adapted for easy grasping by a golfer's hand, and an inner surface adapted for sliding along the shaft 20. The outer surface, for example, can have a smooth or otherwise non-irritating to touch; or may include dimples. The inner surface can have features for minimizing friction, or other features for creating slight sliding friction with the shaft 20, such as to reduce the speed of the backswing. The grip member 50 may be at least partially formed with rigid materials, such as plastic—e.g., PVC, ABS, PP, HDPE, or the like, which are capable of withstanding a force exerted by the user (such as during a swinging motion) without permanent deformation. Such rigid materials may be used with an inner portion of the device to facilitate sliding along the shaft 20. Alternatively or additionally, the grip member 50 may at least partially be formed with resilient and/or soft materials, such an elastomeric material, for example, rubber or the like (e.g., EPDM, silicone rubber, nitrile, etc.). Such soft and/or resilient materials may facilitate gripping of the grip member 50.

The slidable grip member 50 can be made of any suitable material or combination of materials, and may have a seam or other feature allowing it to be selectively removed from the shaft 20. In this manner, the same golf club 10 can be used both with the slidable grip member 50 and without it. In other words, a golfer can incorporate the slidable grip member 50 into an already-owned club, rather than having a separated club dedicated to accommodating the slidable grip member 50. In exemplary embodiments, the grip member 50 includes features for engaging and fixably locking the grip member 50 onto the shaft, and more particularly the grip, so as to use the grip member 50 during play without movement relative to the shaft. For example, the grip member may be frictionally held on the grip, and may include locking mechanisms or other locking elements, as described in further detail below.

Referring to FIGS. 3-6, when using the golf club 10, the golfer holds the handle 30 with his left hand and grasps the slidable grip member 50 with his right hand. More particularly, for example, the slidable grip member 50 can be held by the thumb and index finger of the golfer's right hand.

Figure 4A:
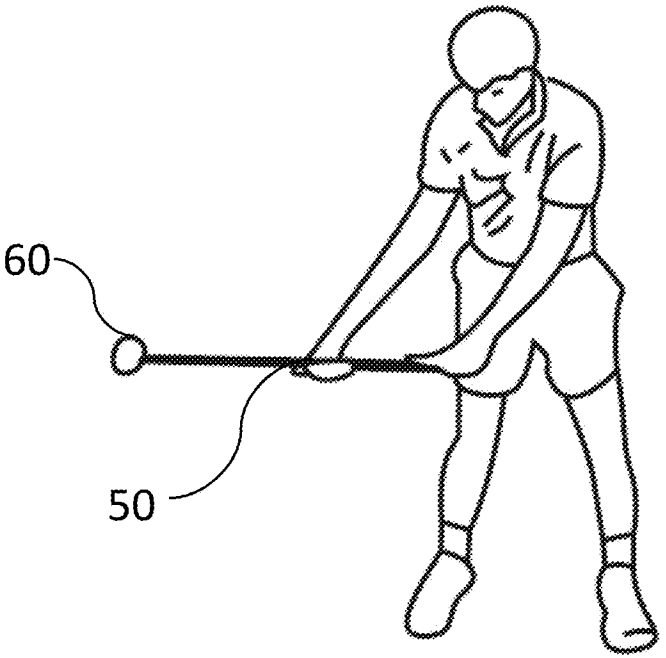
FIGS. 3-5 show a method of using the playing aid device while the user swings the golf club.
Figure 3:
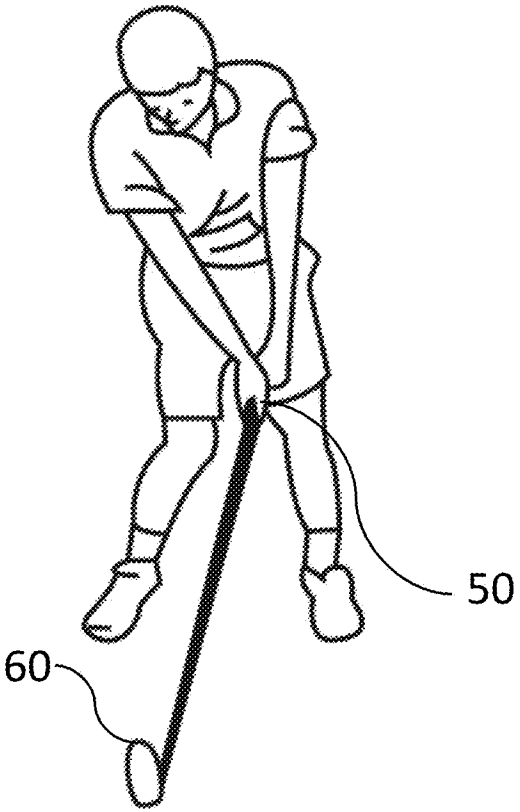
Figure 5:
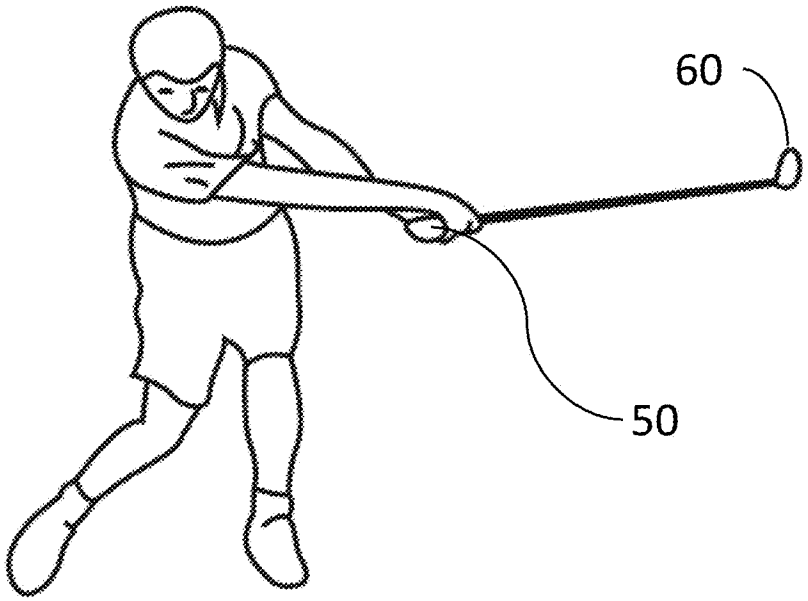
Figure 4B:
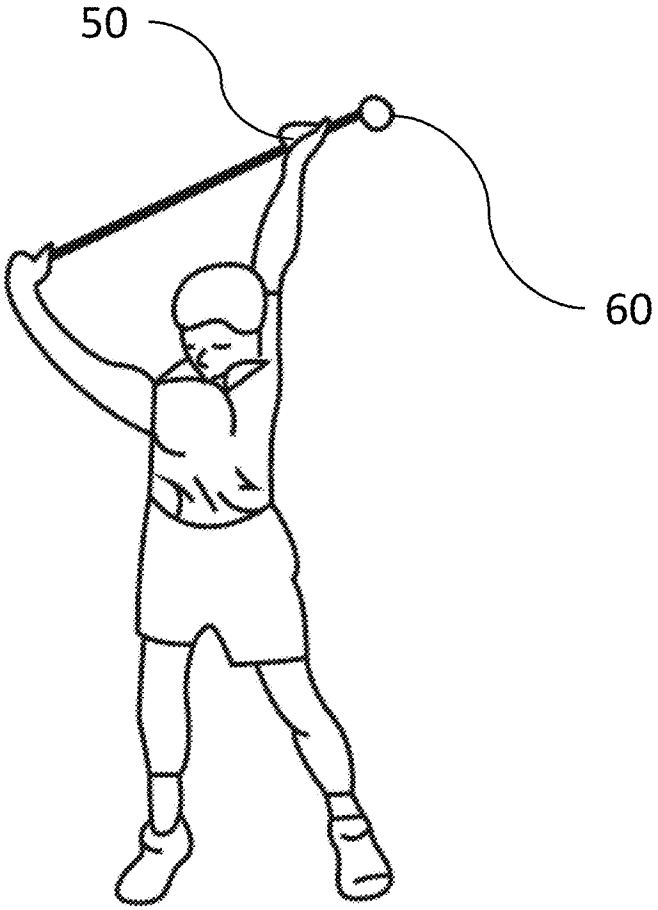
Figure 6:
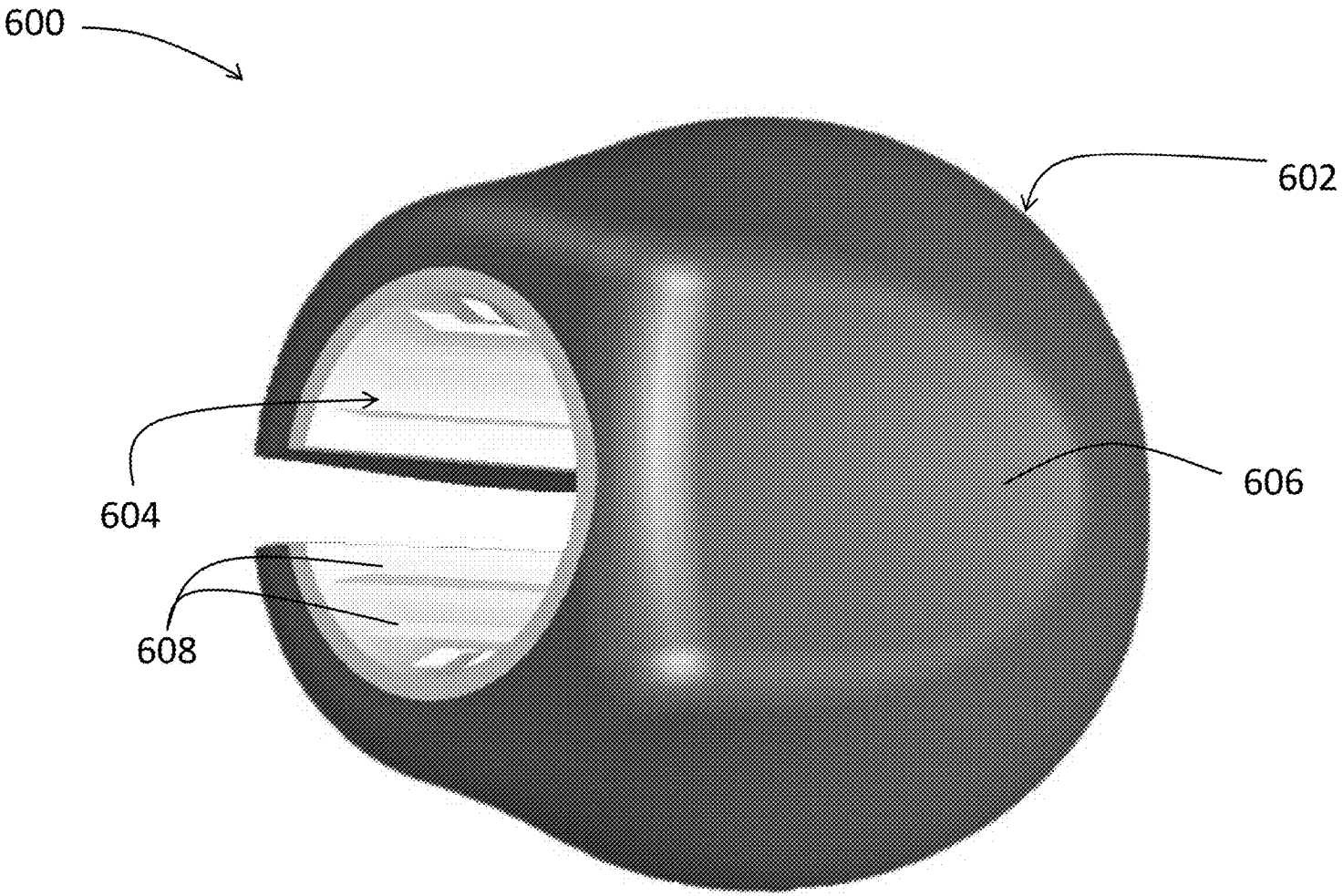
FIG. 6 is a perspective top, front enlarged view of an exemplary golf swing playing aid device according to another embodiment, which is shown without the golf club.
Figure 7:
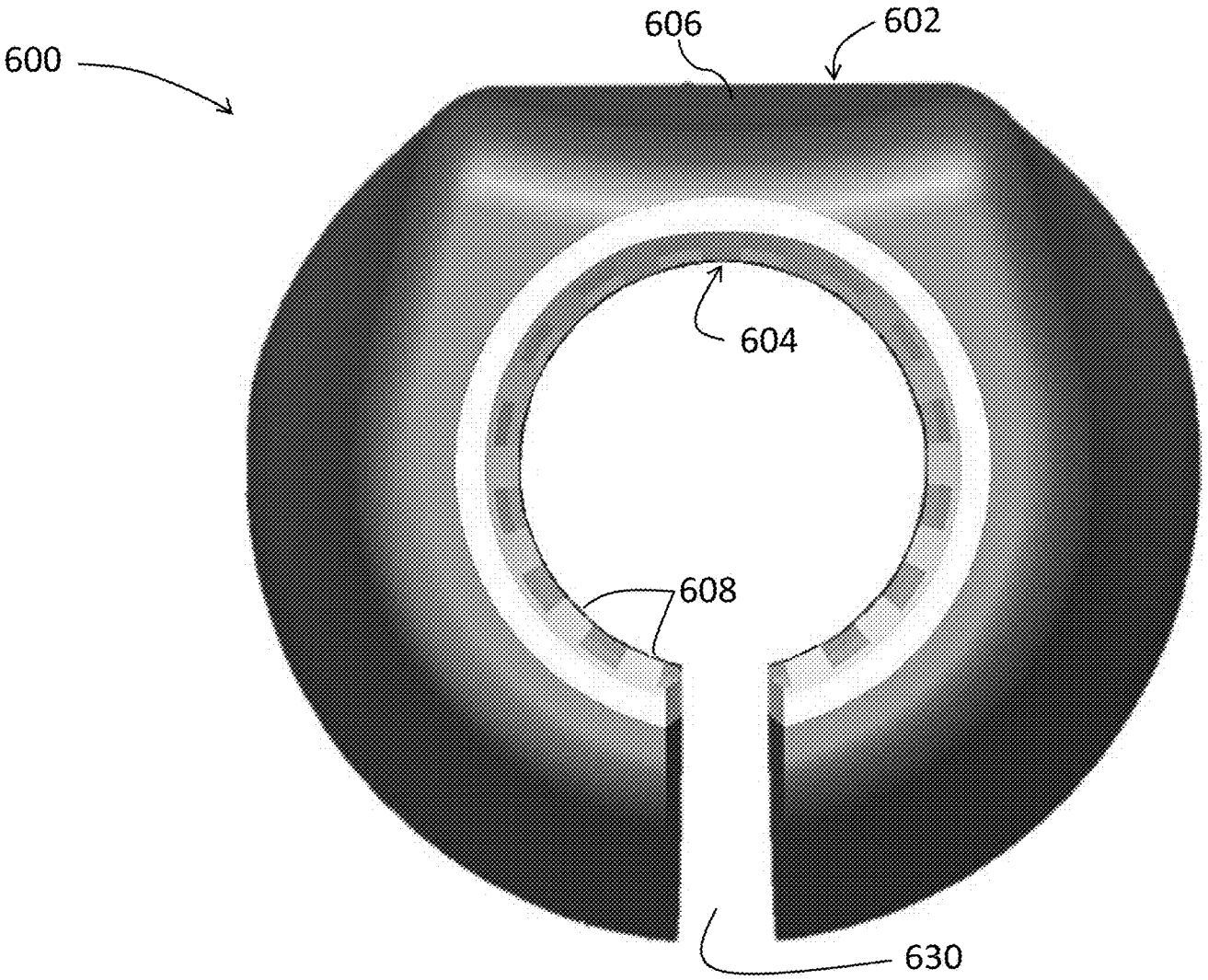
FIG. 7 is a front view of the playing aid device.
Figure 8:
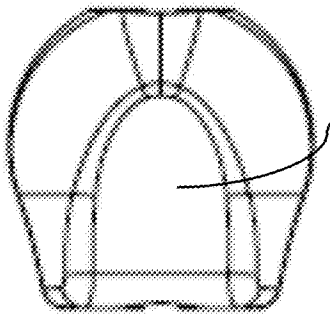
FIG. 8 is a top view of the playing aid device.
Figure 10:
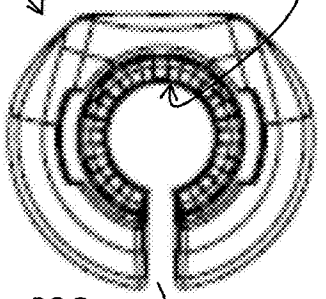
FIG. 10 is a back view of the playing aid device.
Figure 11:
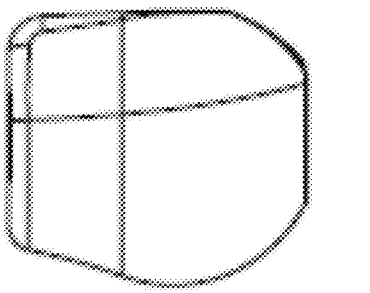
FIG. 11 is a right side view of the playing aid device.
Figure 9:
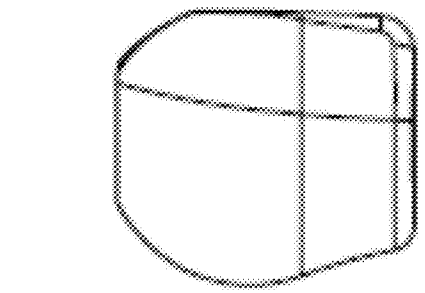
FIG. 9 is a left side view of the playing aid device.
Figure 12:
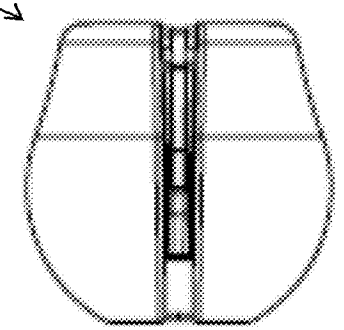
FIG. 12 is a bottom view of the playing aid device.
Figure 13:
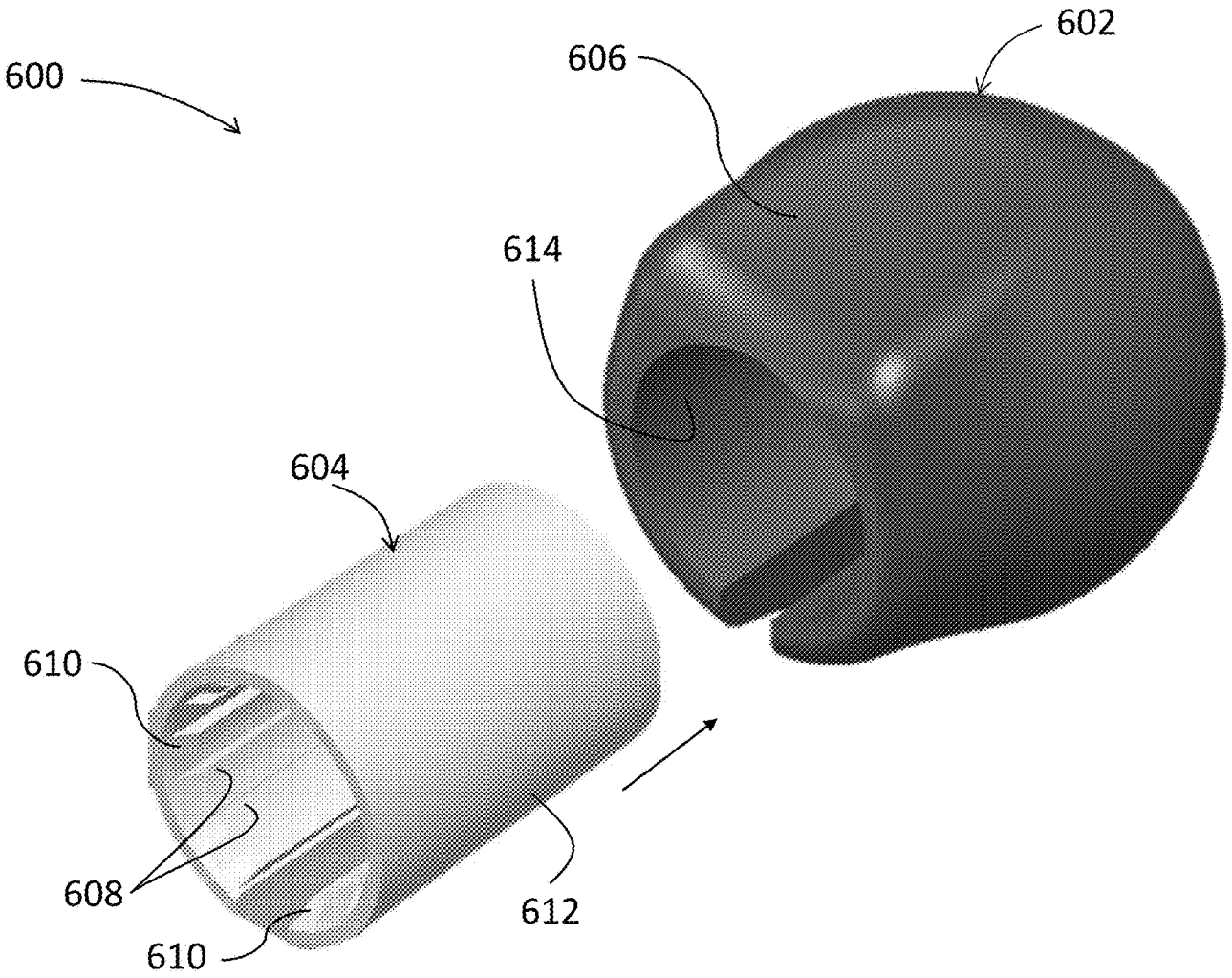
FIG. 13 is an exploded top, front, right perspective view of the playing aid device.
Figures 14A, 14B, 14C, 14D, 14E, 14F:
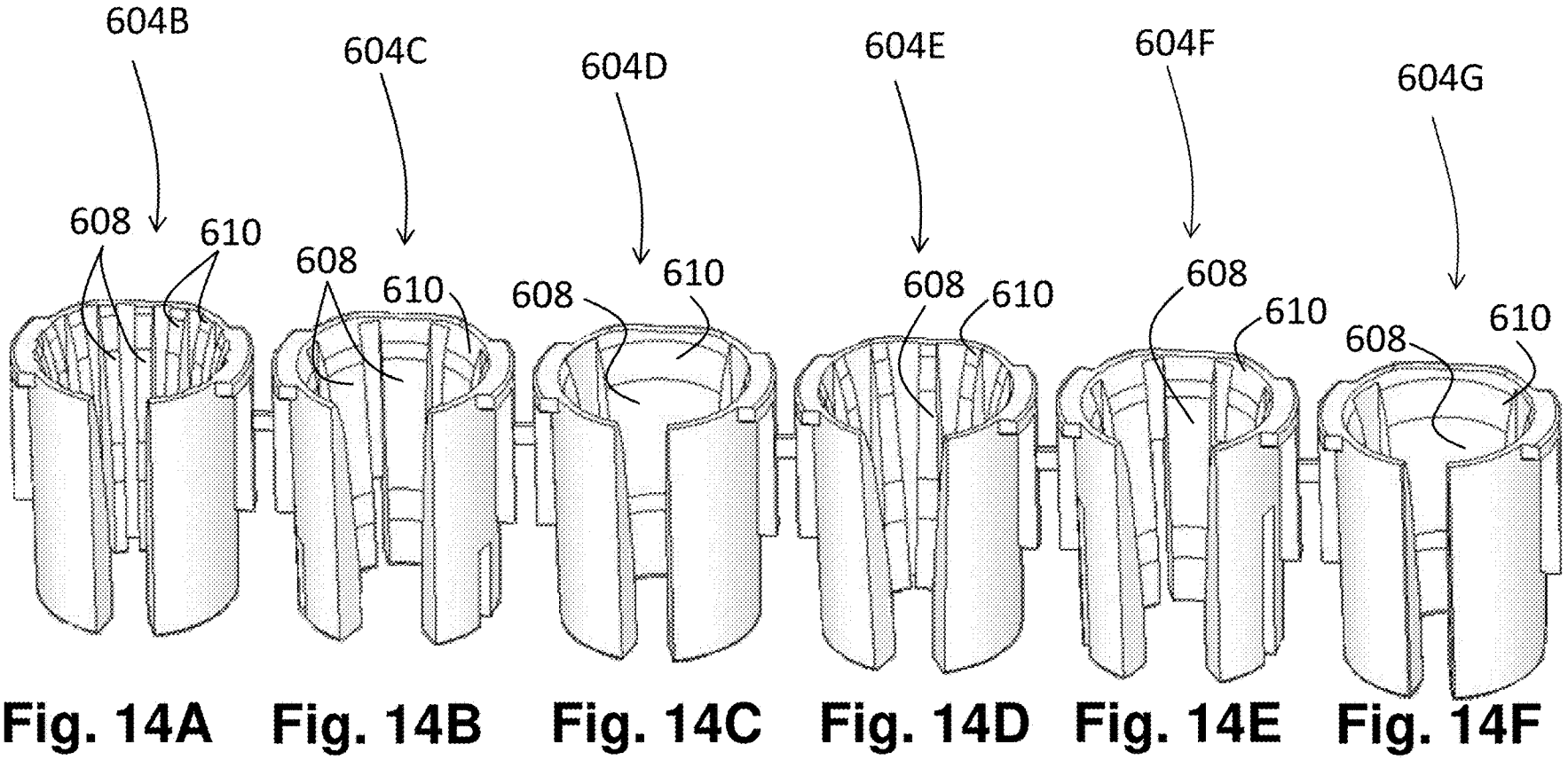
FIGS. 14A-14F show various exemplary embodiments of insertable inner portions for use with the playing aid device.
Figures 15, 16, 17:
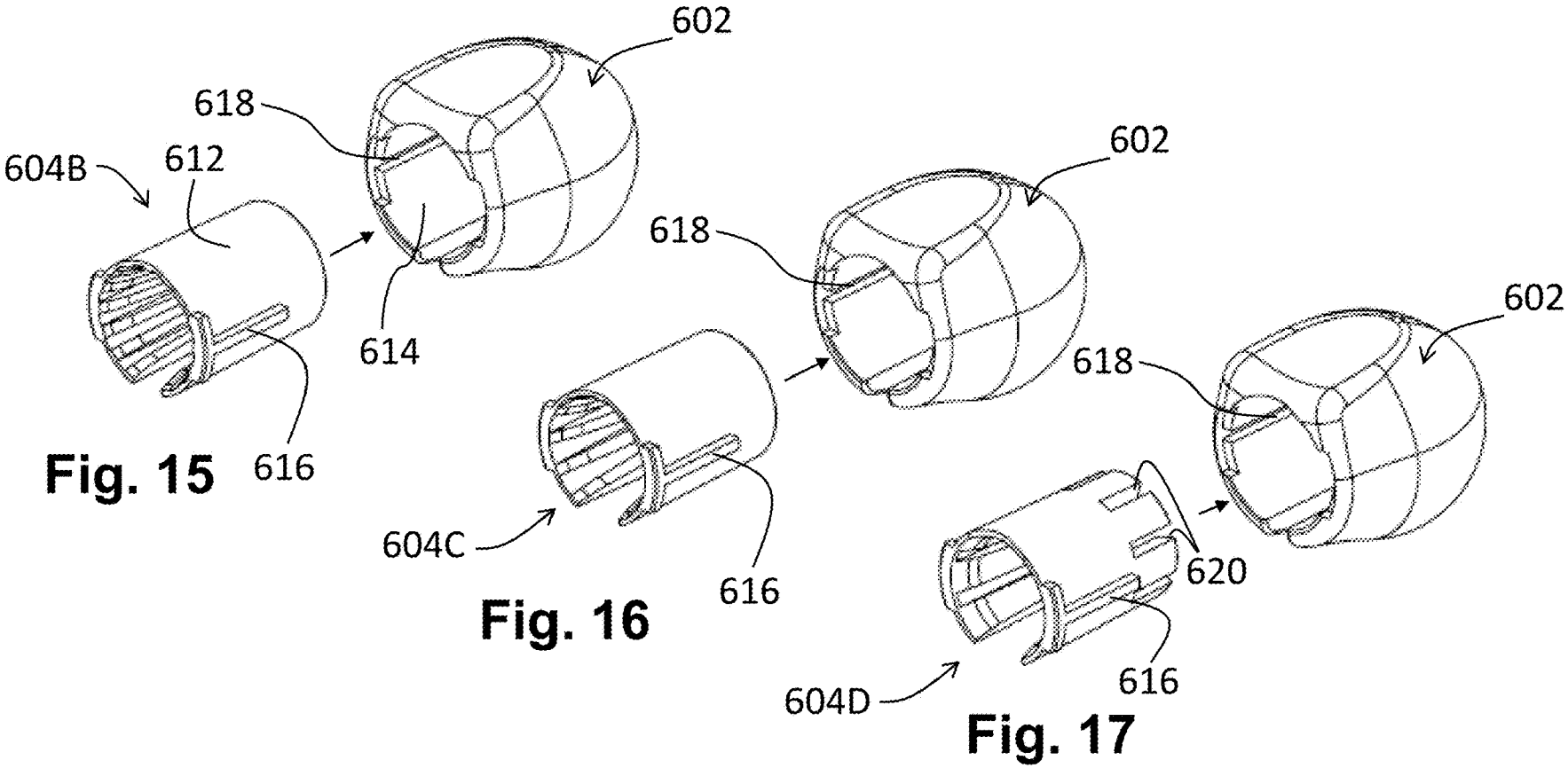
FIG. 15 is an exploded top, front, right perspective view of the insertable inner portion in FIG. 14A with an exemplary grip portion of a playing aid device.
FIG. 16 is an exploded top, front, right perspective view of the insertable inner portion in FIG. 14D with an exemplary grip portion of a playing aid device.
FIG. 17 is an exploded top, front, right perspective view of the insertable inner portion in FIG. 14B with an exemplary grip portion of a playing aid device.
Figure 18:
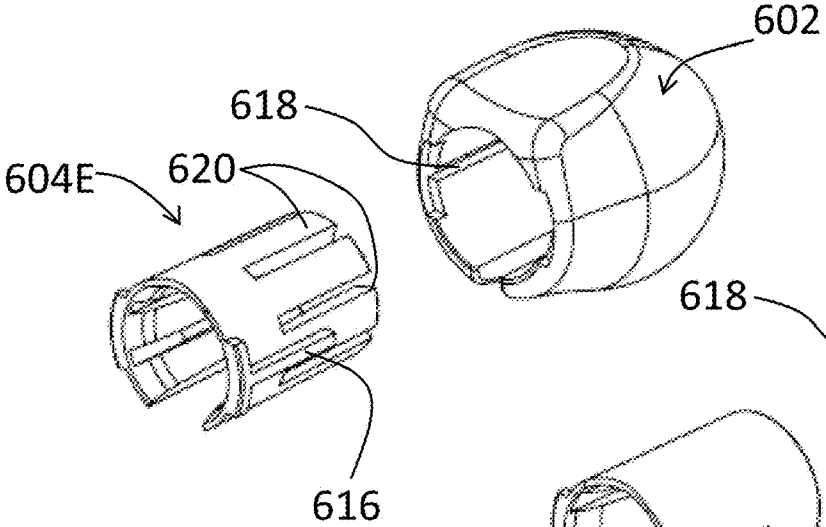
FIG. 18 is an exploded top, front, right perspective view of the insertable inner portion in FIG. 14E with an exemplary grip portion of a playing aid device.
Figure 19:
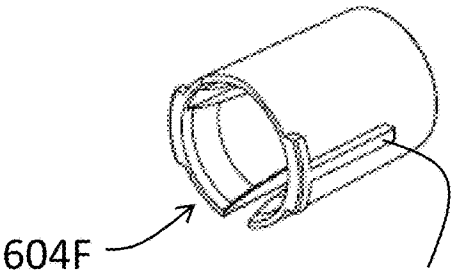
FIG. 19 is an exploded top, front, right perspective view of the insertable inner portion in FIG. 14AC with an exemplary grip portion of a playing aid device.
Figure 20:
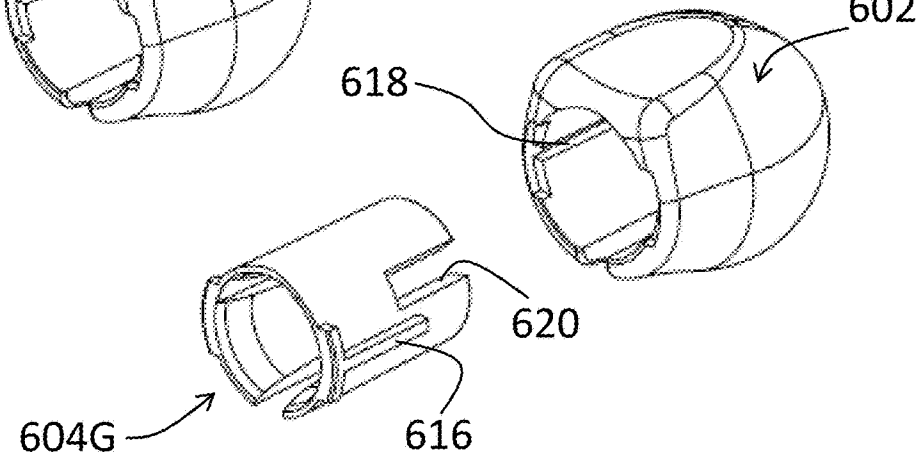
FIG. 20 is an exploded top, front, right perspective view of the insertable inner portion in FIG. 14F with an exemplary grip portion of a playing aid device.
Figure 21:
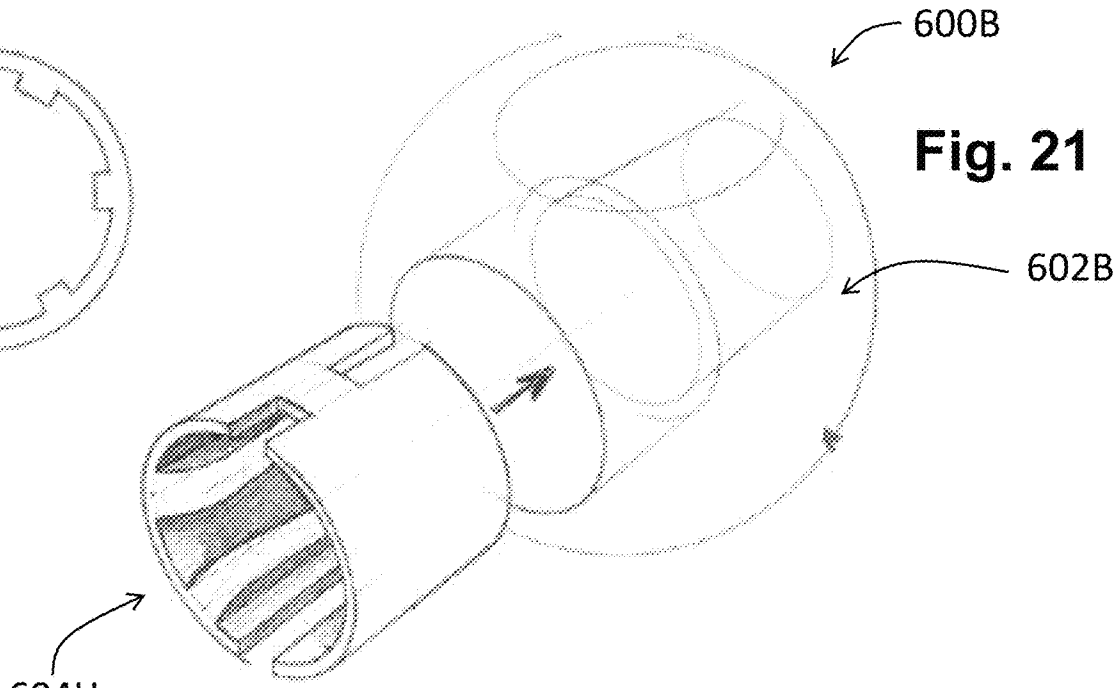
FIG. 21 is an exploded top, front, right perspective view of another embodiment of an insertable inner portion with another exemplary grip portion of an exemplary playing aid device according to another embodiment.
Figure 22:
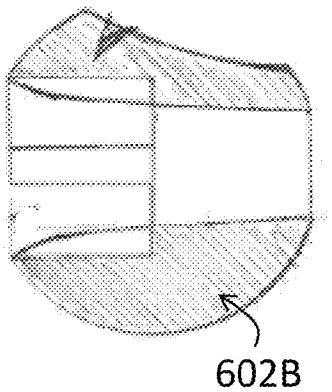
FIG. 22 is a cross-sectional view of the playing aid device in FIG. 21 fully assembled.
Figure 23:
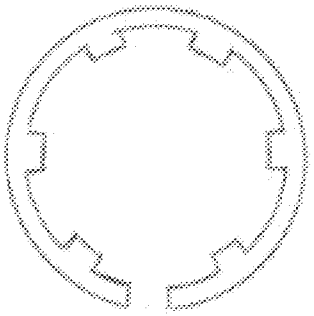
FIG. 23 is a front end view of the insertable inner portion in FIG. 21.
Figure 24:
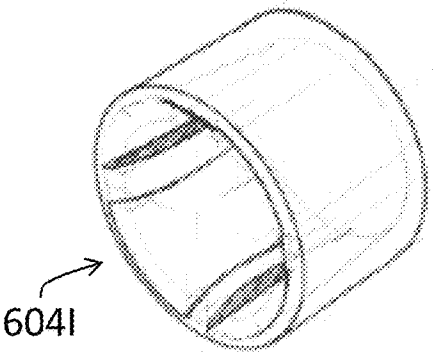
FIG. 24 is another embodiment of an insertable inner portion for use with the playing aid device in FIG. 21.
Figure 25:
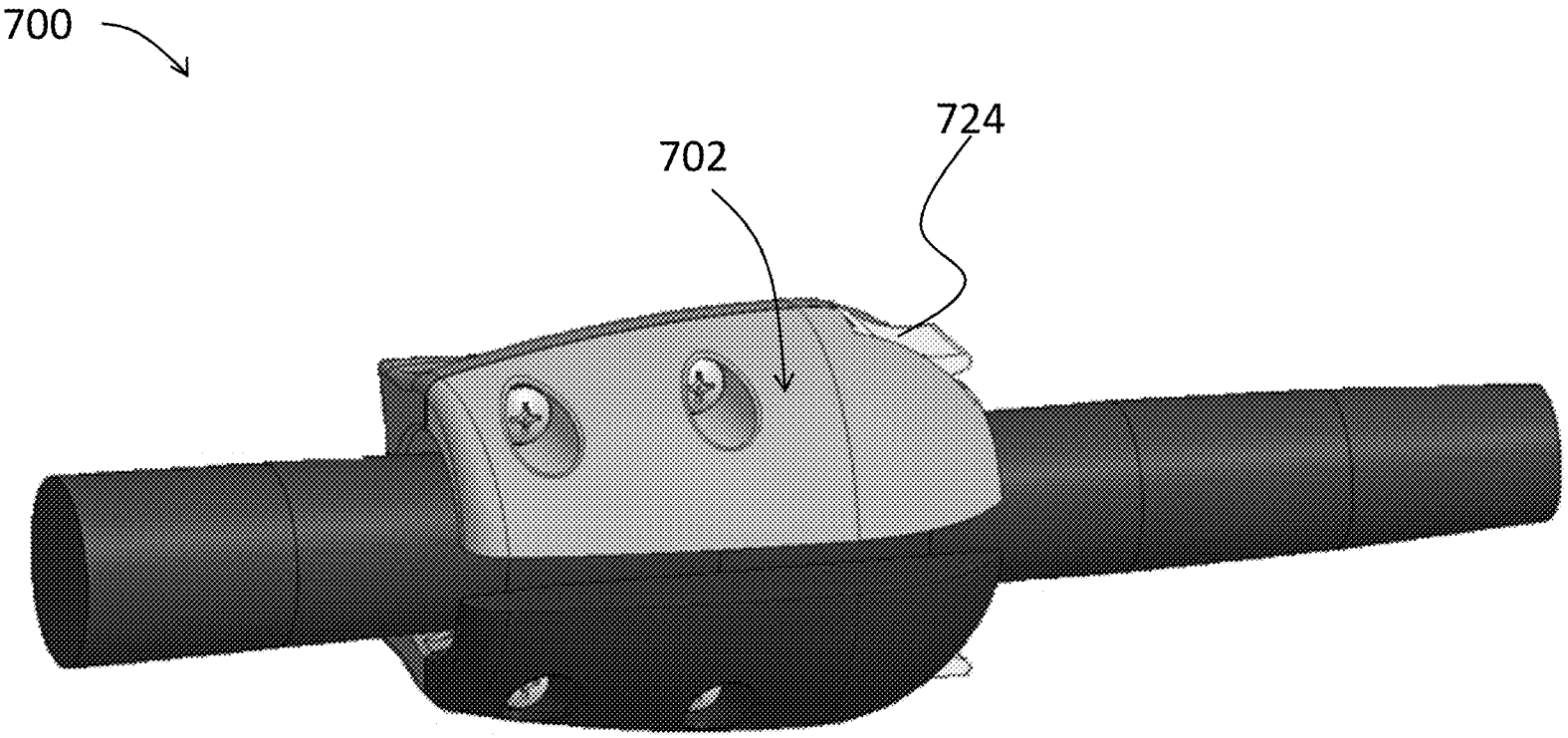
FIG. 25 shows another exemplary embodiment of a playing aid device on a golf club grip.
Figure 26:
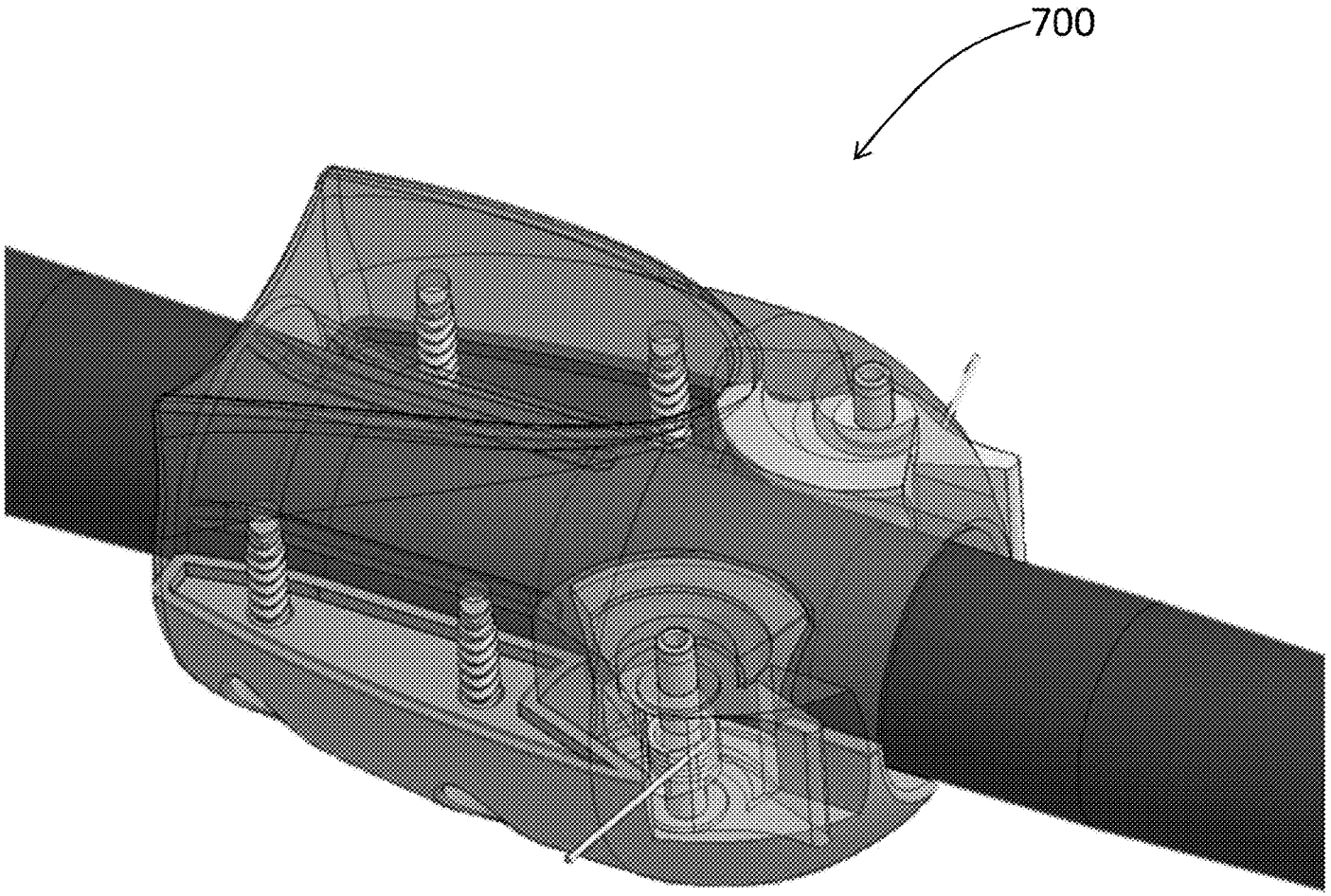
FIG. 26 is a perspective partially transparent view of the playing aid device in FIG. 25.
Figure 29:
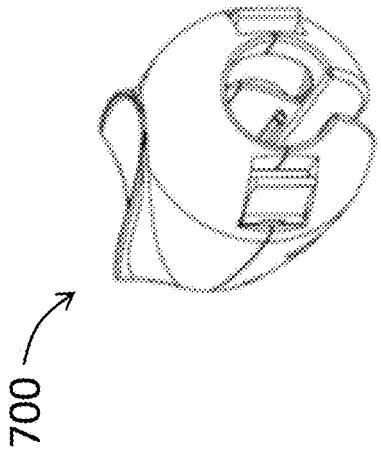
FIG. 29 is a perspective rear end view of the playing aid device in FIG. 25.
Figure 31:
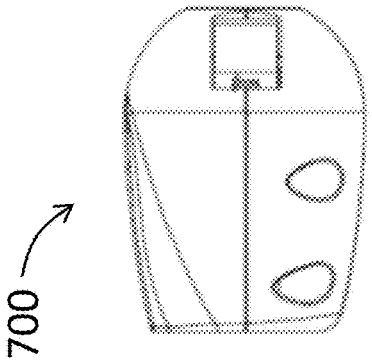
FIG. 31 is a left side view of the playing aid device in FIG. 25.
Figure 28:
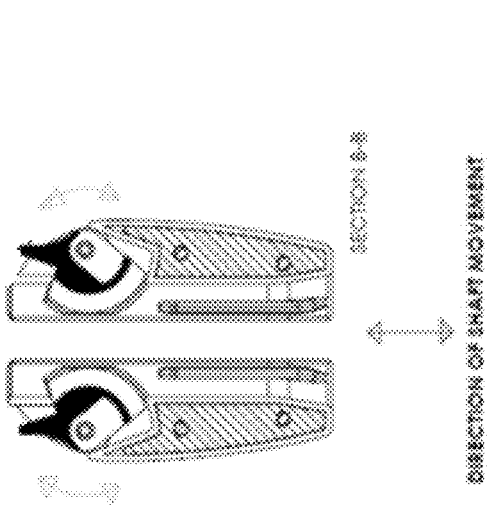
FIG. 28 is a cross-sectional view of the playing aid device in FIG. 25 taken about the line B-B in FIG. 30.
Figure 30:
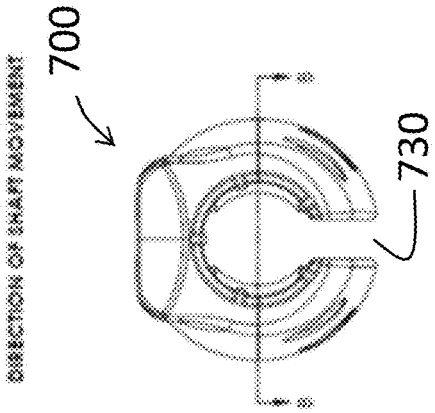
FIG. 30 is a perspective front end view of the playing aid device in FIG. 25.
Figure 27:
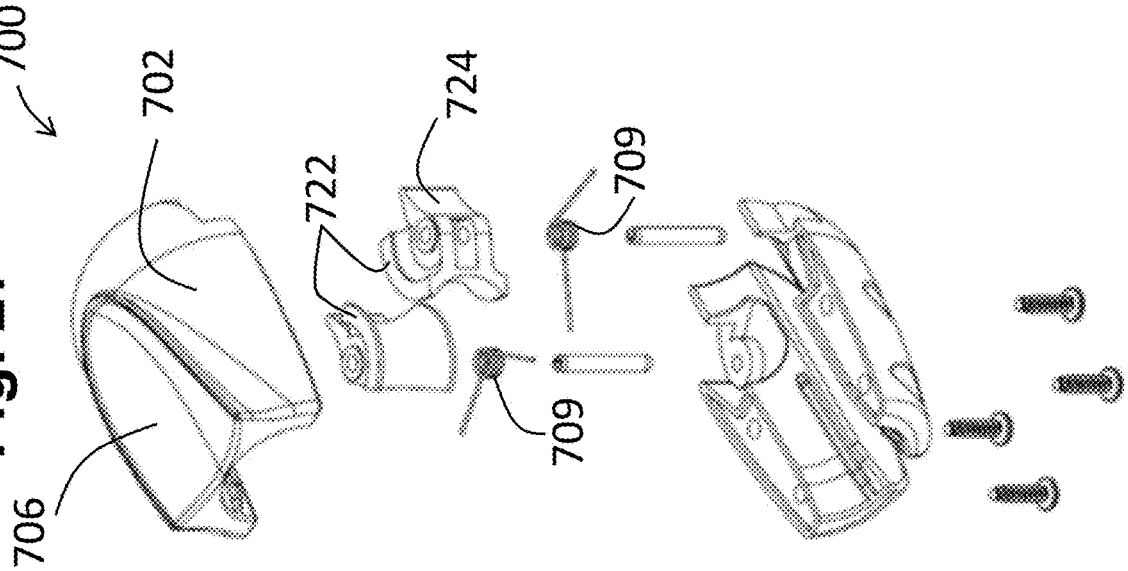
FIG. 27 is an exploded view of the playing aid device in FIG. 25.
Figure 33:
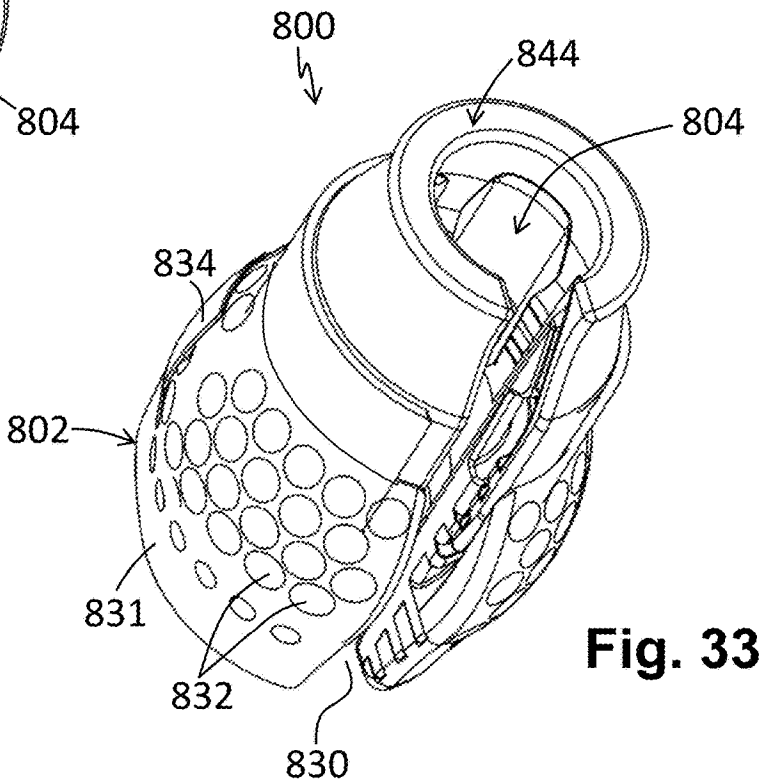
FIG. 33 is a bottom, rear, right perspective view of the playing aid device.

At the starting position, the slidable grip member 50 is situated nearest the handle 30 (FIG. 3). During the backswing, the golfer pushes the slidable grip member 50 away from the handle 30 by separating his hands (FIG. 4A). When the backswing reaches the top position (i.e., fully coiled), the golfer's left arm will be substantially straight and his right hand will extend almost to the head 40 (FIG. 4B). During the downswing, the golfer pulls the slidable grip member 50 back so that, just prior to the impact position, it is again adjacent the handle 30. The golfer's hands, and thus the handle 30 and the slidable grip member 50, remain in close proximity on route to the follow-through position (FIG. 5).

The golf swing playing aid device 50 used on a standard playable golf club 10 allows an aspiring golfer to commit to muscle memory several important aspects and positions of a proper golf swing complemented by the ability to separate the hands during the backswing producing a wide repeatable swing arc, and also promotes the proper sequencing of the swing by forcing the golfer to lead with the hands to start the downswing.

For example, the golfer is conditioned to maintain a substantially straight left arm while at the same time achieving a full shoulder turn and right hand cocking position. Once these two opposing motions have become instinctive with the slidable grip member 50, the golfer can keep his hands together in a conventional golf swing while achieving both proper left arm position and full shoulder turn consistent with the proper golf swing.

In the downswing, the golfer, by throwing the device 50 in their lower hand, learns to feel the dynamics of a full club extension and arc that helps facilitate maximum club head velocity and squaring of the club face at the point of impact. It also affords the golfer the opportunity to reduce tension in and loosen his muscles during a practice swing just prior to executing a regulation golf shot.

For example, during a golf game, the golfer could select the club he is going to use for a particular shot. The slidable grip member 50 can quickly connect to the selected club's shaft for a practice swing. Immediately thereafter, the slidable grip member 50 can be removed from the selected club and the golfer can execute the regulation golf shot with the selected club.

In exemplary embodiments, the outer portion of the gripping member 50 of the playing device has at least a portion thereof that is in a ball-shaped form, such as having a bulbous shape or at least a portion of a spherical shape. At least a majority (e.g., greater than 50%) of the outer surface of the device that is to be grasped by the user may have the ball-shaped form, and preferably almost the entirety of the outer surface of the gripping member may have such a ball-shaped form (e.g., 50%-100%; 60%, 70%, 80%, 90%, etc.). In some embodiments, the portion having the ball-shaped form is configured in the near shape and near size of a regulation golf ball (e.g., sphere of about 43 mm). The ball-shaped form of the gripping member 50 is adapted to be positioned preferably and/or primarily in the fingers of the user's hand when grasping the gripping member 50, like holding a ball ready to be thrown. The device 50 also may have the weight of a regulation golf ball (e.g., about 46 grams). This shape, size and/or weight of the device 50 serve as embodied cognition to remind the golfer they will be throwing this ball in a direct line at the back inside quadrant of the actual ball they have in play. Essentially, such embodied cognition sends a message to the user's conscious mind that they need to complete the task of throwing the playing device 50 at the golf ball in play therefore overriding any subconscious or unconscious thoughts to the contrary.

The golf swing playing aid device 50 used on a standard playable golf club 10 also allows the golfer to practice the proper sequence of initiating the backswing where the hands, arms, shoulders, torso and hips all move simultaneously as one loads weight on the rear foot. The downswing is initiated as device 50 promotes the release of hands on a straight and accelerated path aimed at the inside and back quadrant of the golf ball (preferably one that is in play during a game), followed by the shoulder and hip turn through the impact zone and extension as part of the follow through.

A compelling and disruptive feature of this playing aid device is that it can be used on all irons, hybrids, and woods in an already purchased regulation set of golf clubs. Significantly, this allows the slidable grip member 50 to be used without violating the fourteen-club rule of regulation play. A club from the golfer's conventional set can be used in a normal practice swing as well as in the execution of a golf shot in a regulation golf round. This allows for immediate replication of the muscle memory produced by any correct practice swing influenced by the device.

The slidable grip member 50 promotes proper positioning of the golf club to the golf ball at address, enhances the proper takeaway and subsequent swing plane of the club, the tempo of the swing, the subsequent rotation or "coiling" of the body with full shouldered turn, the uncoiling of the body, the weight shift, the downswing, the hands in a lag position before impact, the ball impact, the hand release, the arm extension, the follow through, the finish and numerous other factors associated with a consistent and repeatable golf swing.

Ultimately, a repeatable golf swing is attributable to proper use of the hands in controlling the golf club in a swing arc and throwing motion that initiates the backswing, downswing, squaring of the club at impact and full extension of the arms during the follow-through. The consistently successful golfer learns to understand, recognize and control the dynamic interface between the golfer, the club, the ball, external forces (e.g., lie, wind, weather and other playing conditions) and the target. This can only be achieved by the diligent study and understanding of the game, the swing, the proper frame of mind and effective practice.

The slidable grip member 50 can be used in combination with a regulation set of golf clubs. For example, the slidable grip member 50 can be kept in the golfer's pocket and/or golf bag during a round of golf. Alternatively, the slidable grip member 50 could remain on the handle 30 even during the regulation golf swing if features are provided to prevent its sliding. For example, it could be removably joined to the lowest part of the golf grip 30.

Accordingly, there is a need for a playing aid device such as the slidable grip member 50 and/or the decals 60 to assist golfers in the development of proper technique and muscle memory to achieve a consistently repeatable and effective golf swing that can be used by the golfer as part of regulation play using one's own golf clubs. Most other aids require purchase of separate clubs that cannot be used as part of one's own normal club golf set and/or used as part of one's normal practice swing just prior to execution of a golf shot.

Turning to FIGS. 6-20, one or more other exemplary embodiments of a golf swing playing aid device including an exemplary grip member 600 are shown. The foregoing description of the gripping member 50 is equally applicable to the gripping member 600, except as noted below. Moreover, it will be appreciated upon reading and understanding the disclosure that aspects of the gripping members 50, 600 may be substituted for one another or used in conjunction with one another where applicable.

As shown in the illustrated embodiment(s), the grip member 600 generally includes an outer portion 602 and an inner portion 604. In the illustrated embodiment(s), the inner portion 604 is a discrete insertable part (e.g., sleeve) that is slidably or fixably insertable into the outer portion 602; although the inner portion and outer portion could be integral and unitary.

The outer portion 602 has a ball-shaped form, and more particularly a bulbous shape, that is configured to fit in the hand, and more particularly the palm and fingers, of the user. The inner portion 604 is configured to slide along the golf club shaft. As described above in connection with the gripping member 50, the grip member 600 is generally configured such that when gripped by the lower hand of the user during a backswing the grip member slides down the shaft toward the head, whereby the hands of the user, when grasping the handle with the upper hand and the grip member with the lower hand can separate progressively during a backswing and then progressively return back into proximity during a downswing and follow-through of a golf swing to thereby promote ingraining a proper, higher quality and more repeatable golf swing into muscle memory.

In the illustrated embodiment, the outer portion 602 of the gripping member 600 of the playing device is configured in the near shape and near size of a regulation golf ball. The gripping member 600 may have a weight, or may have added to it a component with such weight, that makes the overall mass of the device 600 similar to that of a regulation golf ball. This shape, size and/or weight serve as embodied cognition to remind the golfer they will be throwing this ball in a direct line at the back inside quadrant of the actual ball they have in play.

Figure 32:
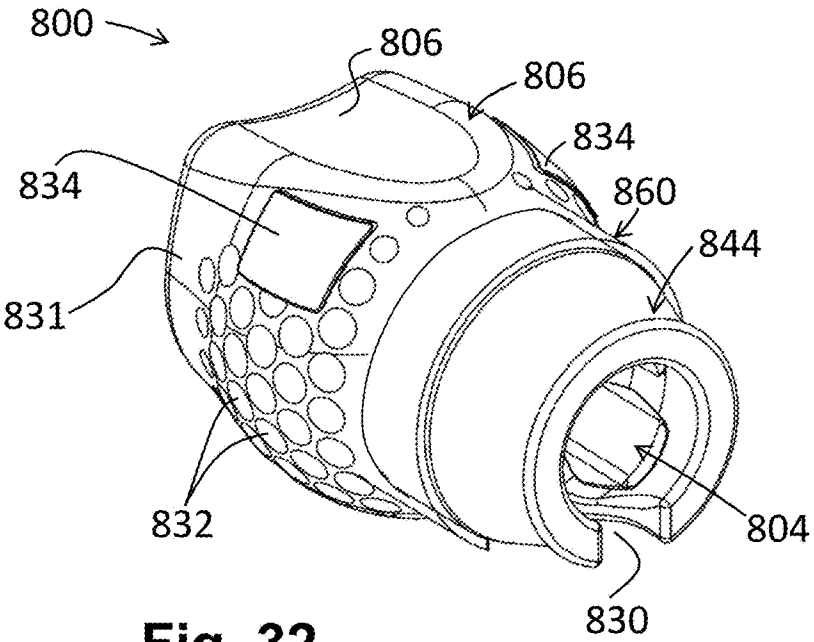
FIG. 32 is a top, rear, right perspective view of another exemplary embodiment of a playing aid device.
Figure 35:
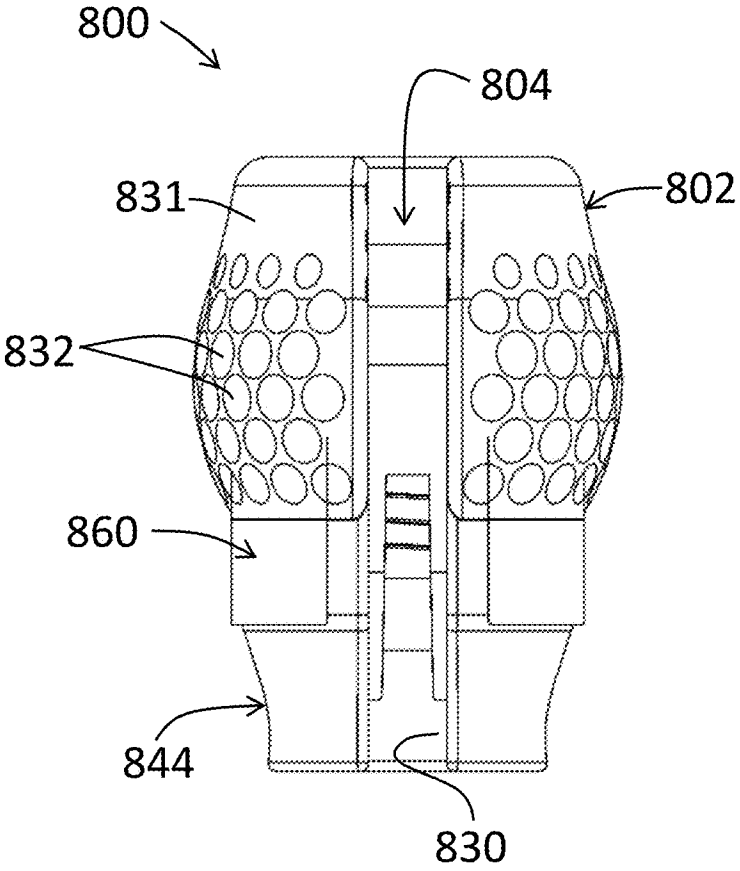
FIG. 35 is a bottom view of the playing aid device.
Figure 34:
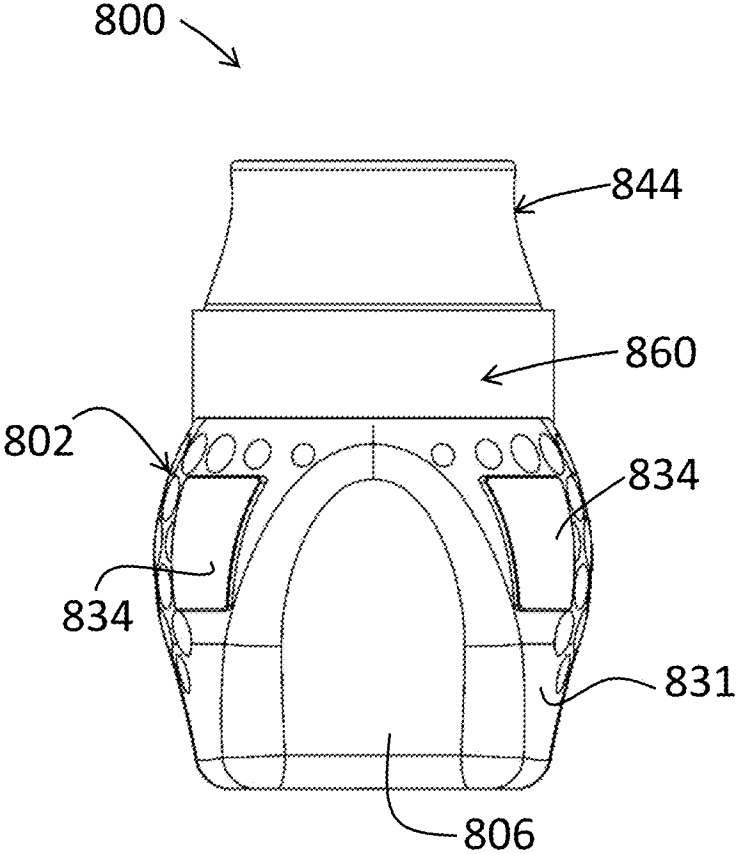
FIG. 34 is a top view of the playing aid device.
Figure 36:
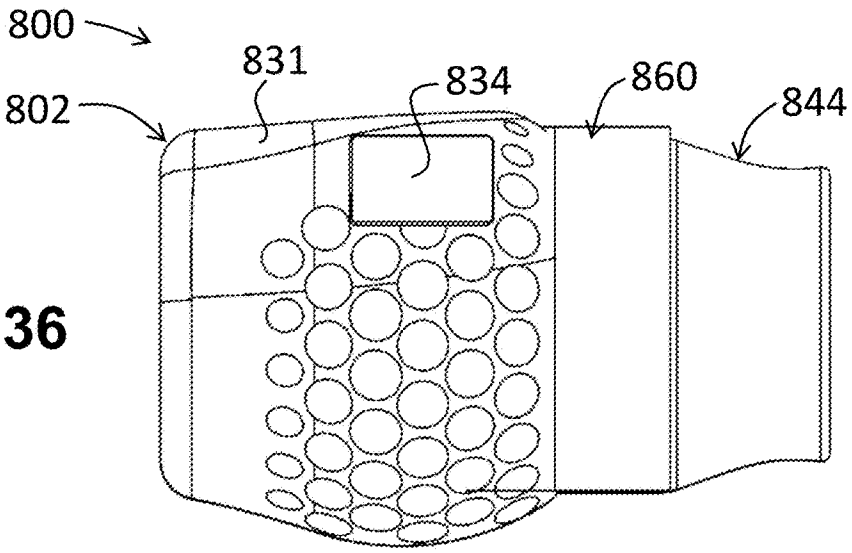
FIG. 36 is a right side view of the playing aid device.
Figure 37:
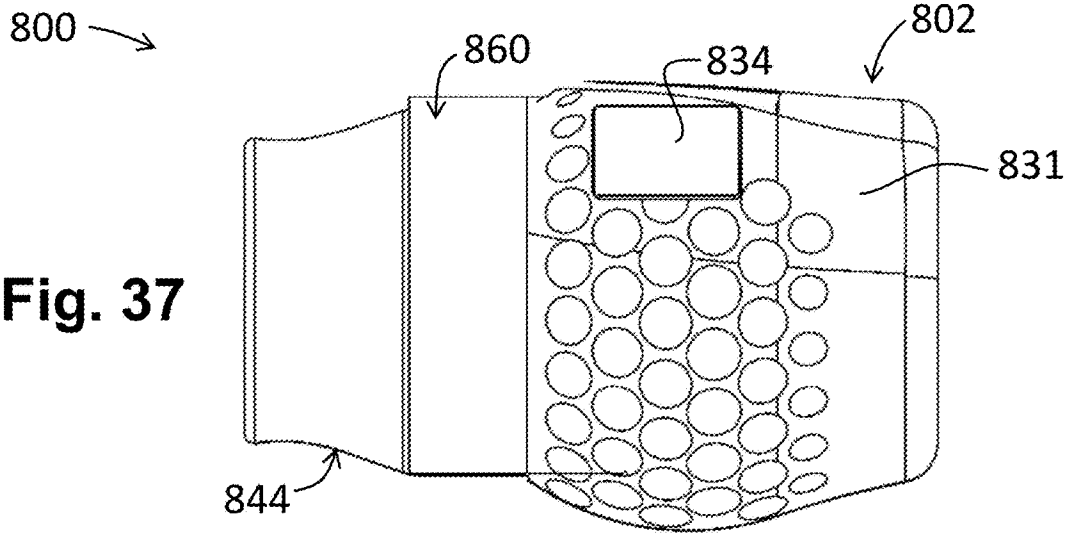
FIG. 37 is a left side view of the playing aid device.
Figure 38:
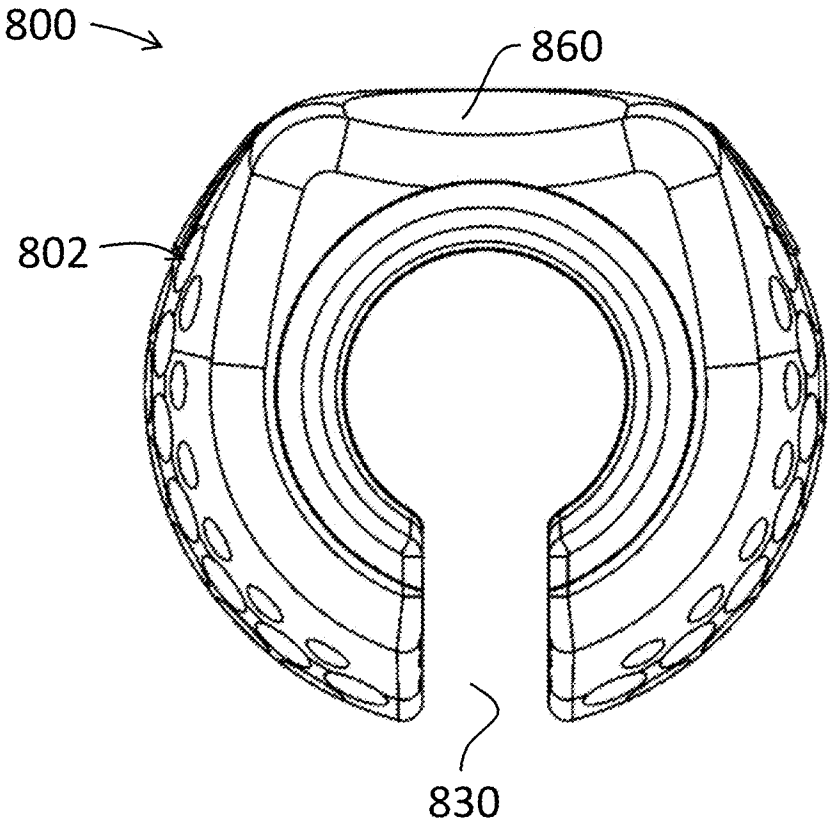
FIG. 38 is a front view of the playing aid device.
Figure 39:
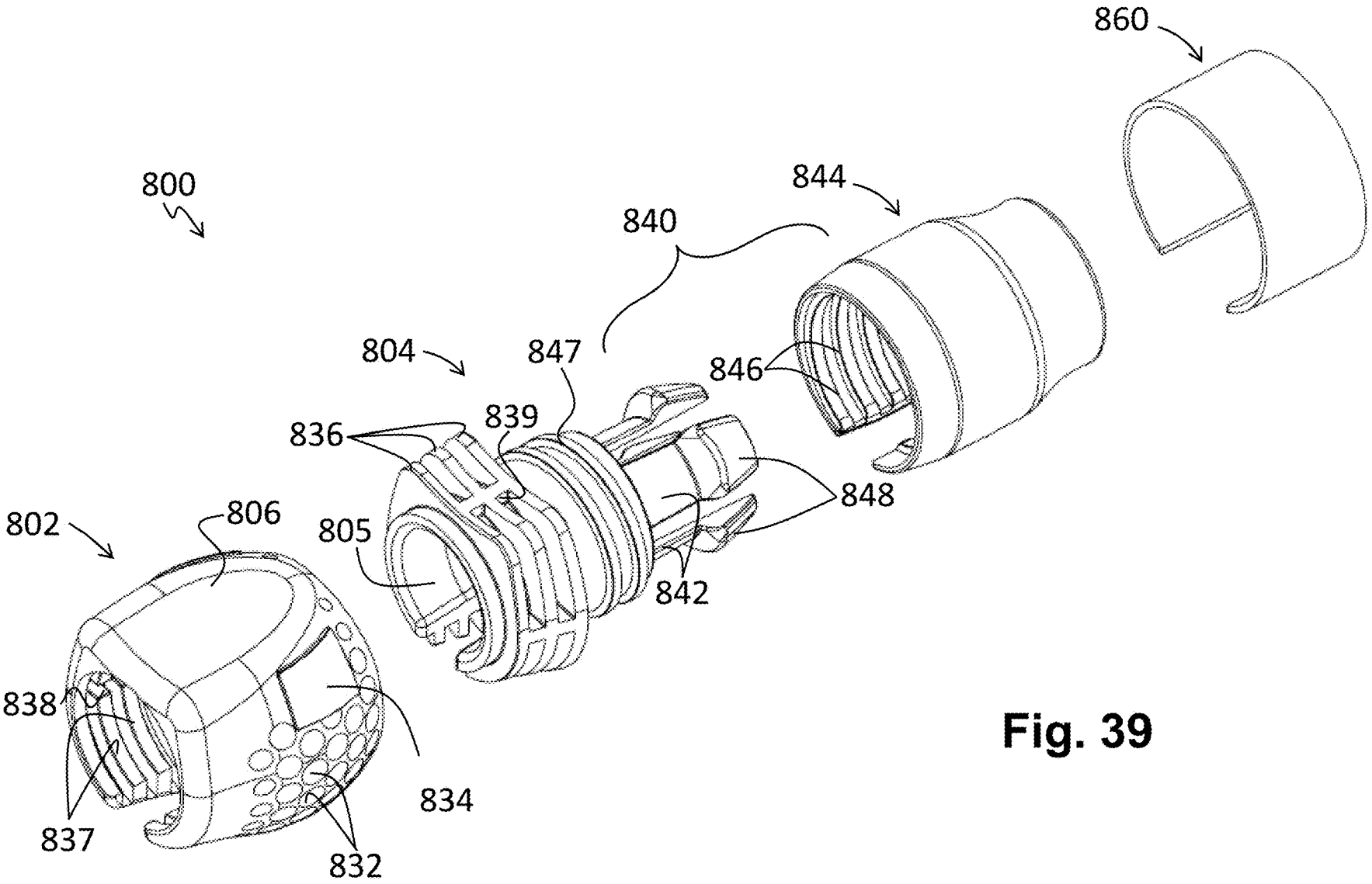
FIG. 39 is an exploded top, right, front perspective view of the playing aid device.
Figure 40:
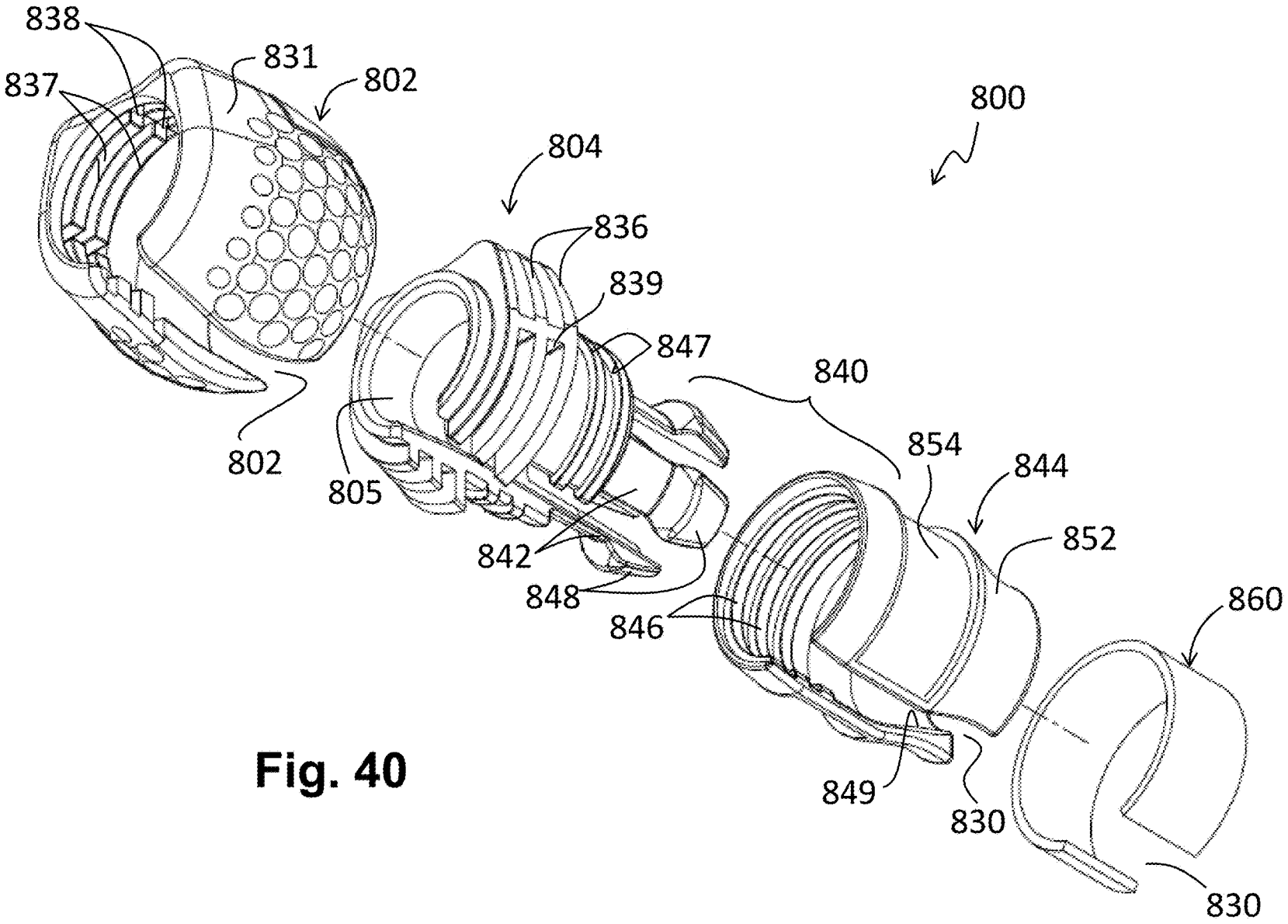
FIG. 40 is an exploded bottom, right, front perspective view of the playing aid device.
Figure 41:
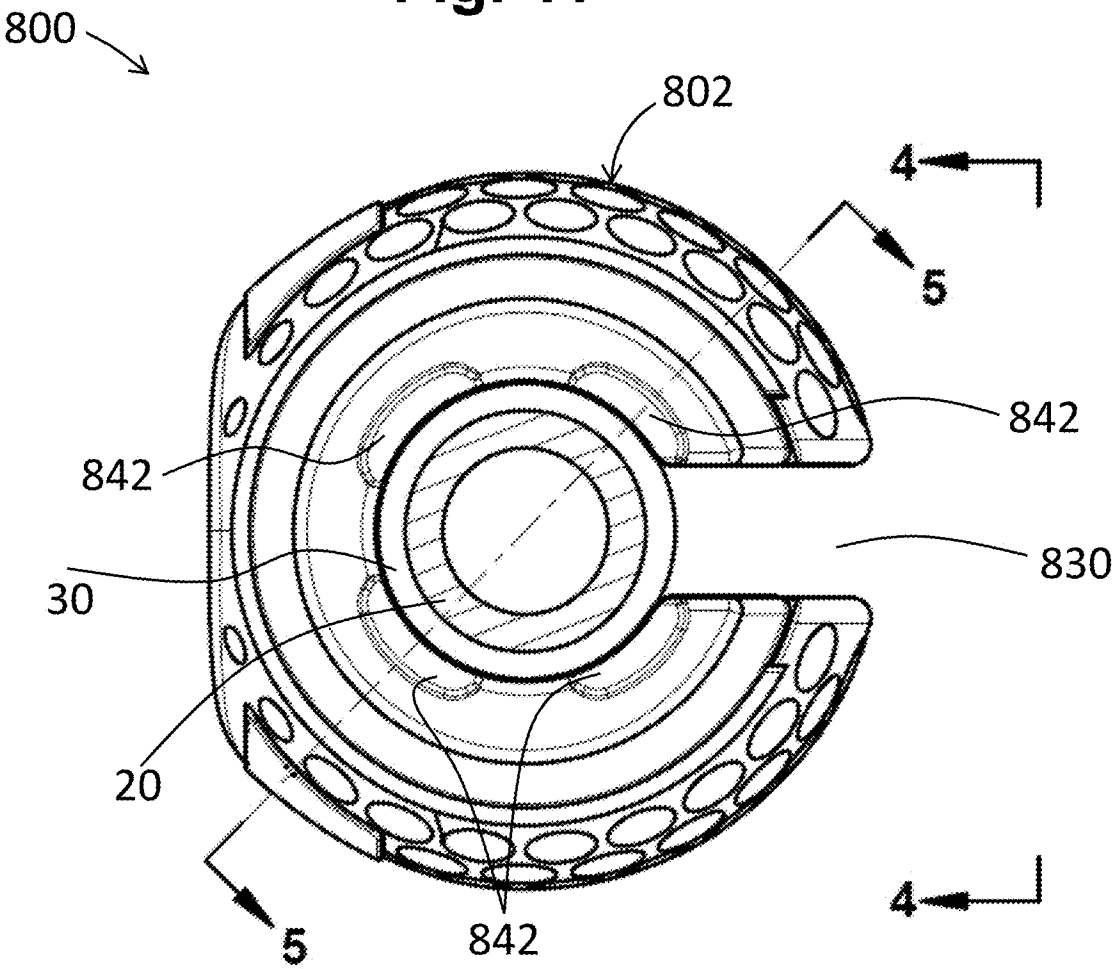
FIG. 41 is a rear view of the playing aid device shown on a golf club grip which is shown in cross-section.
Figure 42:
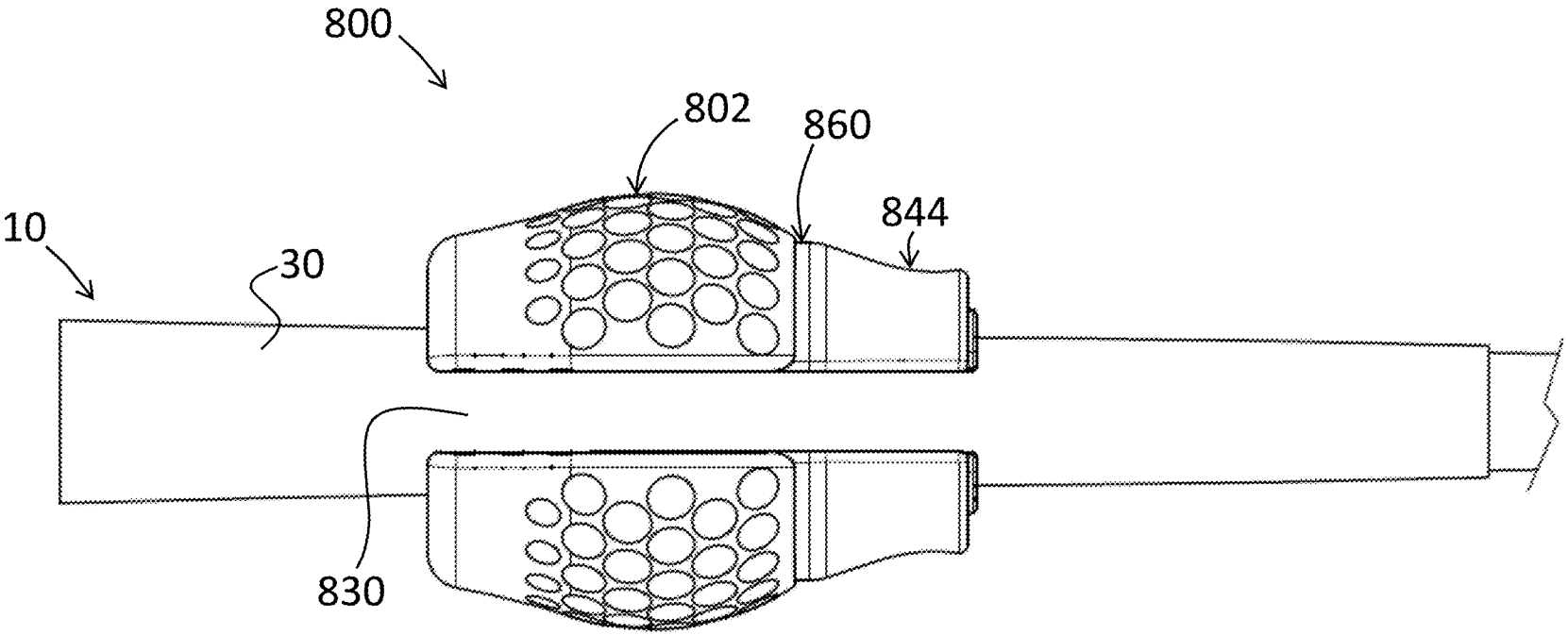
FIG. 42 is a bottom view of the playing aid device shown on the golf club grip taken from the view of line 4-4 in FIG. 41.

The outer portion 602 (particularly the outer surface) may be constructed of a soft rubberized material that is easy to grip and hold in the golfers trailing hand with a thumb indentation 606 at the top of the ball shaped device in direct proximity to the top of the golfer's golf grip and shaft. The thumb indentation 606 enable proper finger positioning and/or proper alignment of the device with a squared club head face. The device allows for placement of the trailing hands middle and index finger on the side of the ball. The outer surface also may be dimpled with indentations promoting a better griping surface (as shown in the embodiment in FIG. 32, for example). The size and softness of the ball shaped portion (e.g., outer shell) of the outer portion 602 is a tactile reminder to the golfer designed to reduce the pressure of the thumb, middle and index finger of the trailing hand which relaxes the muscles in the hand and arm promoting less muscle tension and therefore a faster golf swing.

FIGS. 14A-F and FIGS. 15-20 show various embodiments of the inner portion 604B-604G, which may be configured as an insertable sleeve within the outer portion 602. These various interior inserts 604B-604G are designed to accommodate the various golf grip sizes from standard to mid-size and oversize. Generally, the various inner portions (e.g., inserts) 604, 604B-604G (hereinafter collectively referred to as inner portion with reference numeral 604) may be made of rigid and/or resilient materials, such as plastic that is capable of withstanding a force exerted by the user (such as during a swinging motion) without deformation during the swing, and preferably without permanent deformation. Such materials may be used to maintain the shape of the inner portion 604 thereby facilitating sliding along the golf club shaft 20.

As shown, the inner portion(s) 604 may include a plurality of spline/vanes 608 (or ridges), which may be made of a flexible nylon that fit inside the outer portion 602 (e.g., soft, ball shaped shell), and which allow for resilient expansion to fit various grip sizes. The surface of the inner portion 604 may be designed with specific patterns that allow for ease in sliding the device up and down the shaft as part of the golfer's warmup, stretching routine and associated regulation golf swing. As shown, the inner surface of the inner portion 604 presents an array of grooved surfaces and ridges extending longitudinally along the interior length of the device. When the device is sliding along the non-grip portion of the shaft, the grooves and/or ridges 608 may reduce contact area with the shaft 20 and may reduce friction between the device and the shaft 20. By reducing friction, the speed with which the golfer can swing the club may be increased.

When the device 600 is moved up to the grip, the ridged/grooved surfaces (e.g., vanes 608) of the inner portion 604 may have a configuration of patterns to provide the friction points that secure the device to the golf grip. Securing the device to the grip is to insure it will not turn on the grip during full golf shots which could result in off line golf shots. The inner surface of the inner portion 604 may include one or more gripping elements (such as vanes 608) that are configured to grippingly engage the grip handle. The gripping elements may include friction elements. The gripping elements may include resilient elements, such as resilient portions of the inner portion, for example a flexible plastic. The vanes 608 may each have a chamfered surface 610 for improving the ease of the device coming up over the grip/handle. The inner portion 604 may include a plurality of circumferentially spaced apart slots 620 configured to enhance flexibility of the inner portion.

In exemplary embodiments, the inner portion 604 is also designed so that the opening proximal to the golf club hosel is smaller in diameter than the opening proximal to the golf grip. This allows the device to move freely up the gradually widening golf grip towards the grip handle at the position proximal to the placement of the trailing hands thumb, middle and index fingers.

Generally, the various vanes 608 of each inner portion 604 shown in FIGS. 14A-F are designed to test which thickness and shape impacts the ease by which the device moves up and down the golf shaft and grip. In addition, which vane configuration provides the greatest adherence to the grip surface preventing the device from spinning or turning during actual full golf swings so as not to alter the flight of the shot toward the intended target. Generally, thinner vanes move more easily on the shaft and grip but do not provide the best adherence to the grip to prevent turning or spinning during full shots. Where the vane surfaces are directly below the locations in which the golfer applies thumb and middle and index finger pressure on the outer surface of the device is believed to be the most functional place to promote adherence of the device to the grip eliminating the spinning or turning action. In addition, as shown in FIGS. 15-20, an outer surface 612 of the inner portion 604 may include anti-rotation elements, such as protrusions 616, that are configured to cooperate (e.g., slide into) corresponding anti-rotation elements, such as recesses 618, on an inner surface 614 of the outer portion 602. The gripping member 600 also includes an axial slot 630 configured to permit attachment and removal from the shaft.

FIGS. 21-24 show another exemplary embodiment of a gripping member 600B having an outer portion 602B and inner portion 604H or 6041. The foregoing description of the gripping member 50, 600 is equally applicable to the gripping member 600B. Moreover, it will be appreciated upon reading and understanding the disclosure that aspects of the gripping members 50, 600, 600B may be substituted for one another or used in conjunction with one another where applicable. Generally, the gripping member 600B has a ball-shaped form that is more spherical than the bulbous shape of the gripping member 600.

FIGS. 25-31 show another exemplary embodiment of a gripping member 700. The foregoing description of the gripping member 50, 600, 600B is equally applicable to the gripping member 700, except as noted below. Moreover, it will be appreciated upon reading and understanding the disclosure that aspects of the gripping members 50, 600, 600B, 700 may be substituted for one another or used in conjunction with one another where applicable.

As shown in the illustrated embodiment, the outer surface 702 of the gripping member 700 has a rounded ball shaped form at its rearward portion (closer to the club head where the fingers are placed), but the forward portion of the body is more elongated than that of the gripping member 600, for example. The outer surface 702 of the gripping member 700 also includes a thumb indentation for placing the thumb and orienting the device, similarly to the gripping member 600. In the illustrated embodiment, the device is formed in shell segments which are fastened together with fasteners.

As shown, the gripping member 700 includes a cam device 722 designed to promote a smooth sliding of the device up and down the golf shaft and grip, while also allowing the device 700 to be securely locked onto the grip. The cams 722 are spring biased with springs 709, which improve the usability with various size grips. For example, the springs 709 may allow the cams 722 to accommodate the expanding contours of any size grip/handle as the device moves up the grip towards its handle. In exemplary embodiments, the surfaces of the cams 722 will have textured surfaces to facilitate smooth transitions up and onto the golf grip to the typical trailing hand position. The surfaces also may be designed to adhere to various golf grip materials to secure the device for golfers' full shots. The cams 722 can be depressed against the grip to better ensure the device does not turn loose when the golfer executes a full golf shot causing the golf ball to fly off line to the intended target.

As shown, the golfer can lock the cams 722 in place using their fingers to depress one or more tabs 724 so that it puts additional pressure via the patterned surface of the cam onto the grip surface. In exemplary embodiments, the cam 722 is somewhat tear dropped shaped so that in the locked position more of its surface adheres to the grip. The golfer then releases the depressed cams 722 to allow the device to move freely up or down the grip and or associated golf shaft.

FIGS. 32-44 show another exemplary embodiment of a golf swing playing aid device having a gripping member 800. The foregoing description of the gripping member 50, 600, 600B, 700 is equally applicable to the gripping member 800, except as noted below. Moreover, it will be appreciated upon reading and understanding the disclosure that aspects of the gripping members 50, 600, 600B, 700, 800 may be substituted for one another or used in conjunction with one another where applicable.

As shown in the illustrated embodiment, the grip member 800 generally includes an outer portion 802 and an inner portion 804. The outer portion 802 has a ball-shaped form, and more particularly a bulbous shape, that is adapted to fit in the hand, and more particularly the palm and fingers, of the user. The inner portion 804 is configured to slide along the golf club shaft. In the illustrated embodiment, the inner portion 804 is configured as a discrete part that is insertable into and fixable to the outer portion 802. The gripping member 800 (e.g., the inner portion 804, outer portion 802 and/or other components) also may include an axial slot 830 configured to facilitate attachment and removal from the golf club shaft.

As described above in connection with the gripping member(s) 50, etc., the grip member 800 is generally configured such that when gripped by the lower hand of the user during a backswing the grip member slides down the shaft toward the head, whereby the hands of the user, when grasping the handle with the upper hand and the grip member with the lower hand can separate progressively during a backswing and then progressively return back into proximity during a downswing and follow-through of a golf swing to promote a more perfect and repeatable golf swing, and to promote ingraining such a swing into muscle memory.

In the illustrated embodiment, the outer portion 802 of the gripping member 800 of the playing device is configured in the near shape and near size of a regulation golf ball. The gripping member 800 may have a weight, or may have added to it a component with such weight, that makes the overall mass of the device 800 similar to that of a regulation golf ball. This shape, size and/or weight serve as embodied cognition to remind the golfer they will be throwing this ball in a direct line at the back inside quadrant of the actual ball they have in play.

The outer portion 802 (particularly the outer surface 831) may be constructed of a soft rubberized material that is easy to grip and hold in the golfers trailing hand with a thumb indentation 806 at the top of the ball shaped device in direct proximity to the top of the golfer's golf grip and shaft. The thumb indentation 806 enables proper finger positioning and/or proper alignment of the device 800 with a squared club head face. The device allows for placement of the trailing hands middle and index finger on the side of the ball. As shown, the outer surface 831 also may be dimpled with indentations 832 promoting a better griping surface. The size and softness of the ball shaped outer surface 831 (e.g., outer shell) of the outer portion 802 is a tactile reminder to the golfer designed to reduce the pressure of the thumb, middle and index finger of the trailing hand which relaxes the muscles in the hand and arm promoting a looser and faster golf swing. One or more regions 834 of the outer surface of the outer portion 802 may be smooth and/or elevated or recessed for placing decals, such as promotional logos, or QR codes for instruction for using the device 800.

In the illustrated embodiment, the inner portion 804 (e.g., insert) is insertable inside of the outer portion 802, and is configured to attach to the outer portion 802 to restrict or prevent relative movement between the inner and outer portions 804, 802. As shown, the inner portion 804 includes a plurality of radially outwardly protruding teeth 836 that are configured to interlink with corresponding radially inwardly protruding teeth 837 on the inside of the outer portion 802. The ends 838 of the teeth 837 of the outer portion 802 may engage stop surfaces 839 between the teeth 836 of the inner portion 804 to restrict rotation between the inner and outer portions 804, 802.

The inner surface 805 of the inner portion 804 may have a design that allows for ease in sliding the device up and down the shaft as part of the golfer's warmup, stretching routine and associated regulation golf swing. In the illustrated embodiment, the inner surface 805 of the inner portion 804 is a smooth surface. It is understood, however, that the inner surface 805 may have an array of surface features, such as grooved surfaces and ridges extending longitudinally along the interior length of the device, similarly to that of gripping member 600. The inner portion 804 may be made of a rigid material, such as plastic, that has sufficient rigidity to resist deformation during the swing, thereby facilitating sliding movement along the shaft 20.

The exemplary golf swing playing aid device having the grip member 800 also includes a unique locking mechanism 840 that enables the gripping member 800 to selectively fasten or release from the grip/handle 30 of the shaft 20. As shown, the locking mechanism 840 includes a plurality of resilient (e.g., flexible) locking elements 842 that are formed from part of the inner portion 804. The resilient locking elements are configured to cooperate with an intermediate portion 844 of the device 800, such as a discrete locking sleeve 844, that is engageable with the resilient locking elements 842 to selectively move them between a locked position engaging the grip 30 (e.g. FIG. 44) and a released position from the grip 30 (e.g., FIG. 43).

As shown in the illustrated embodiment, for example, the locking sleeve 844 includes inner threads 846 that threadably engage with outer threads 847 of the inner portion 804. The resilient locking elements 842 are configured as fingers 842, which include a radially outward tapered surface 848 that tapers inwardly as it extends toward its rearward end. The locking sleeve 844 includes a corresponding radially inward tapered surface 849 that tapers inwardly as it extends toward its forward end. The fingers 842 may be made of a suitable flexible material, such as a polymer (e.g., nylon or the like), that enable the fingers 842 to resiliently move off their normal axes to cause them to repeatably lock against or release from the grip 30. The intermediate portion 844 may be made of a rigid material, such as plastic, that is configured to resist deformation during the swing.

Figure 43:
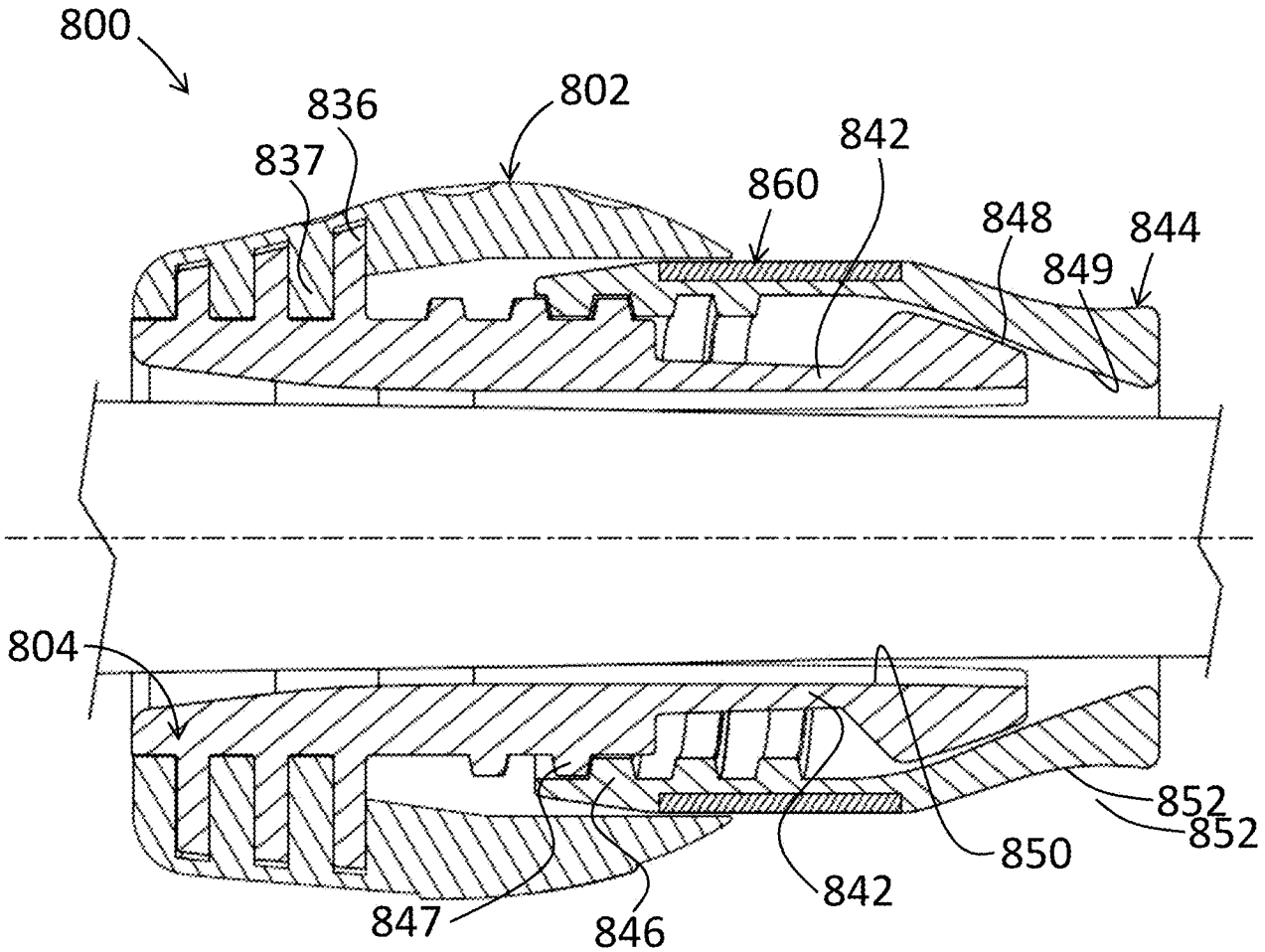
FIG. 43 is a cross-sectional view of the playing aid device shown on the golf club grip taken about the line 5-5 in FIG. 41, in which the playing aid device is shown in an exemplary unlocked state.

As shown in FIG. 43, when the locking sleeve 844 is threaded toward the release state (e.g., toward the rearward end away from the outer portion 802), the tapered surface 849 of the sleeve 844 relative to the tapered surface 848 is at a radially enlarged portion of the sleeve 844, such that the sleeve tapered surface 849 does not force the fingers 842 inwardly to secure the device 800 to the grip 30. In such a release state, the fingers 842 may still engage the grip 30, however, the force that they apply generally is not sufficient to cause them to hold against the grip 30; thus allowing the device 800 to be slid down the shaft 20 or removed completely from the club 10.

Figure 44:
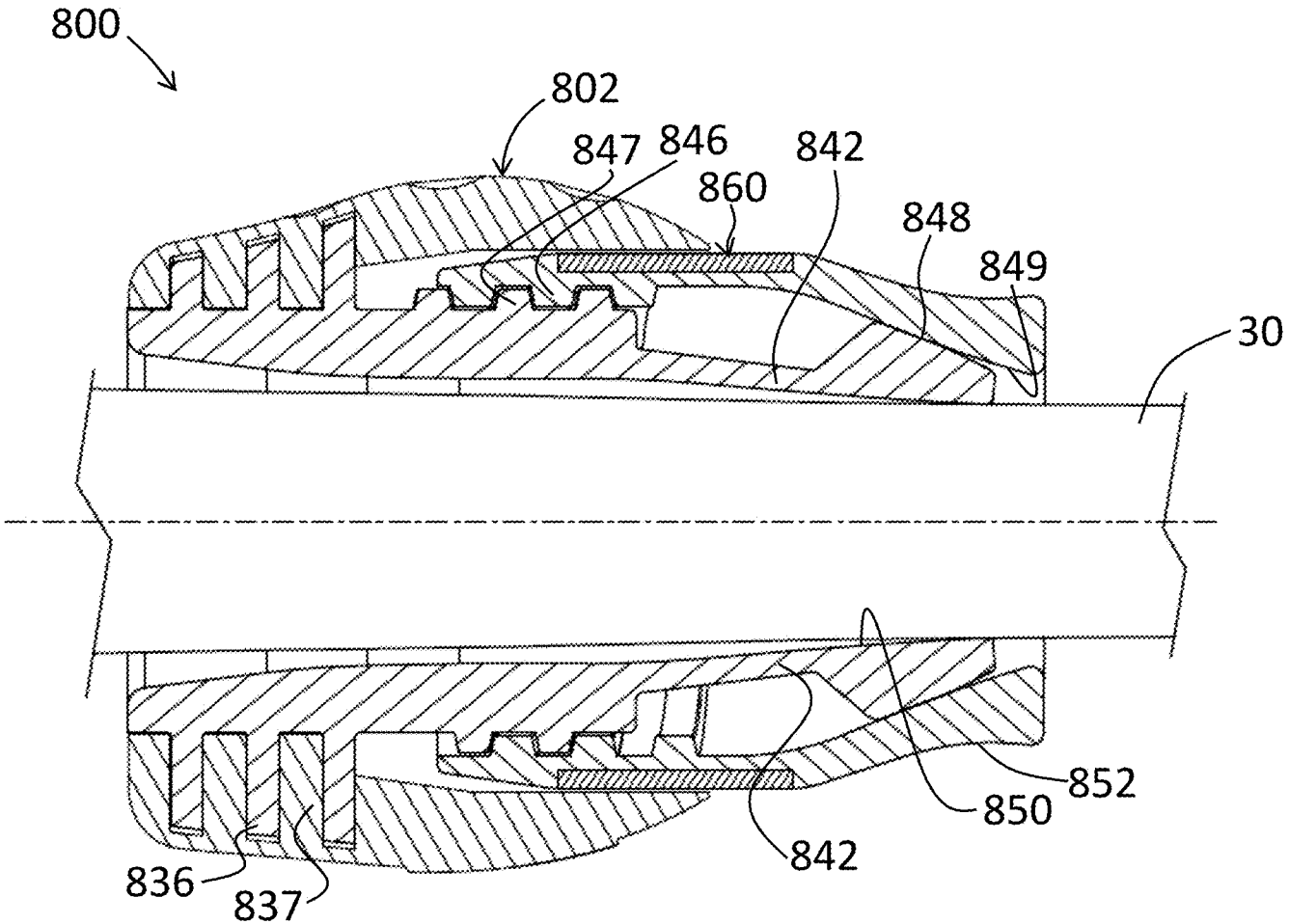
FIG. 44 is a cross-sectional view of the playing aid device shown on the golf club grip taken about the line 5-5 in FIG. 41, in which the playing aid device is shown in an exemplary locked state.

As shown in FIG. 44, when the locking sleeve 844 is threaded toward the lock state (e.g., advanced forward toward the outer portion 802), the tapered surface 849 of the sleeve 844 relative to the tapered surface 848 is at a radially narrow portion of the sleeve 844, such that the sleeve tapered surface 849 forces the fingers 842 inwardly to secure the device 800 to the grip 30. In such a lock state, the fingers 842 cinch down and bite into the grip 30, thereby securing the device 800 onto the grip 30, preferably with sufficient force to allow the user to maintain a grip on the device 800 while making a normal golf swing, and without the device 800 rotating or moving during the swing.

In exemplary embodiments, the radially inward surface 850 of the fingers 842, such as at the distal rearward end portions, may include frictional features, such as a frictional material (e.g., grit) or protuberances to facilitate gripping of the fingers 842 onto the handle/grip 30. The locking sleeve 844 also may include a friction material at its radially outer surface 852 to facilitate the user to grip the sleeve 844 and thread it onto the inner portion 804. As shown, the intermediate portion 844 (e.g., sleeve 844) may protrude from the rearward end of the outer portion 802. A portion of the radially outer surface 852 of the sleeve 844 that protrudes from the outer portion 802 may have an inwardly tapered surface (shown at 852), which may provide an ergonomic design for the placement of the user's fingers.

It is understood that other suitable designs for the locking mechanism 840 could be employed. For example, the fingers 842 could be biased radially outwardly toward a release state, and upon engagement/advancement with the locking sleeve 844 the fingers 842 could be forced inwardly for locking engagement with the grip. Other spring biased features for selectively locking and releasing the device 800 also could be employed.

In exemplary embodiments, the gripping member 800 also includes a weighted component 860. The weighted component 860 may be added to makes the overall mass of the device 800 similar to that of a regulation golf ball; or have sufficient mass to serve as embodied cognition to remind the golfer they will be throwing this ball in a direct line at the back inside quadrant of the actual ball they have in play. In the illustrated embodiment, the weighted component 860 is formed as a split collar, and may be disposed in a recess 854 in the radially outer surface 852 of the locking sleeve 844. The component 860 also may serve as a bushing that reduces friction with the outer portion 802 as the locking sleeve 844 is threaded back and forth on the inner portion 804.

Figure 45:
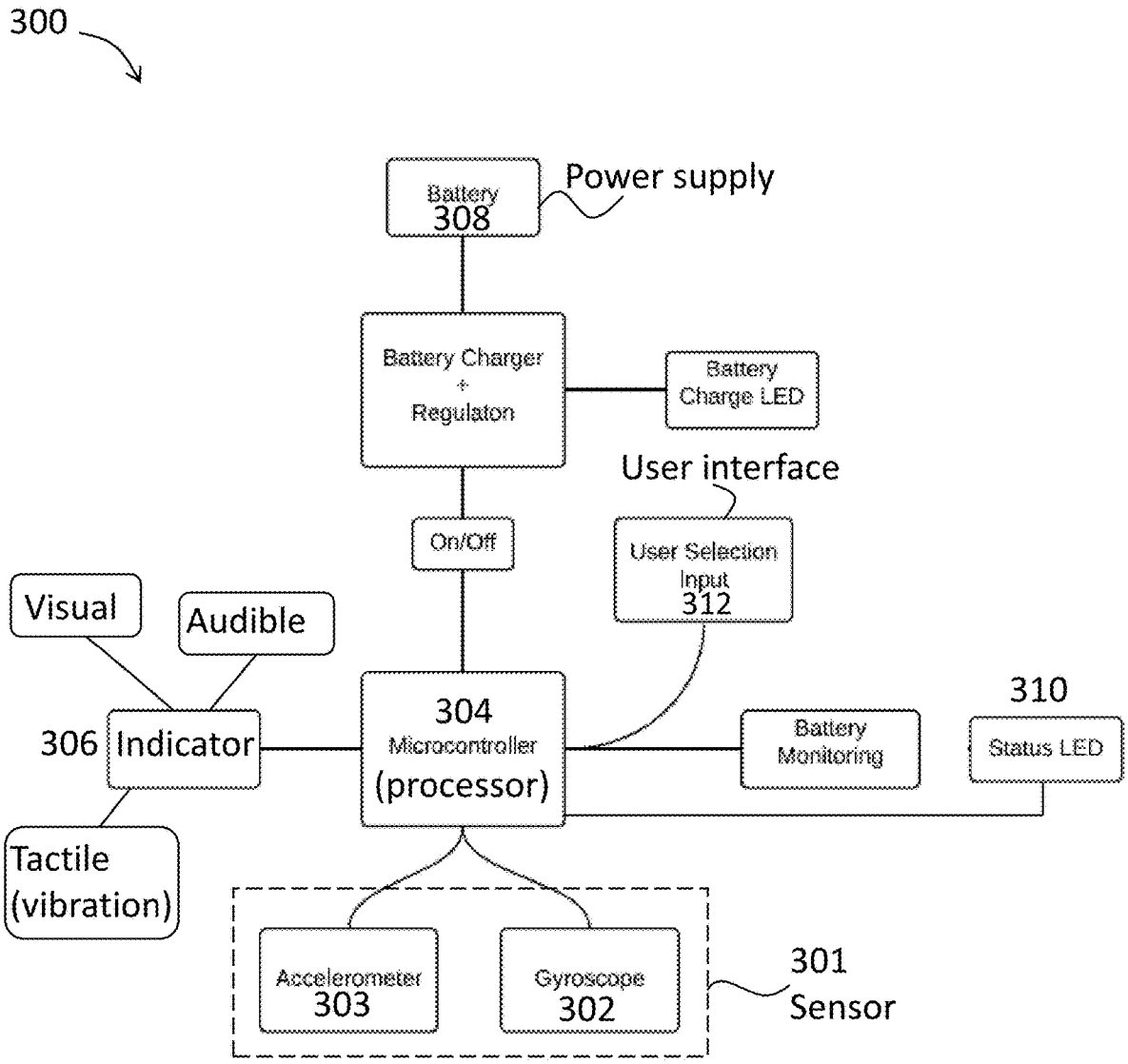
FIG. 45 shows a block diagram illustrating modules or functional elements of an electronic device of an exemplary golf swing playing aid device according to an embodiment.

Turning to FIG. 45, elements of an electronic device 300 are shown. The electronic device 300 may be provided for determining and indicating whether the golfer's wrist has cocked during the backswing (e.g., wrist-cock function). Alternatively or additionally, the electronic device 300 may be provided for determining, estimating, and indicating the distance of a shot (e.g., shot distance function). The electrical device 300 may be provided on the handle 30 or other portion of the golf club 10. The electrical device 300 may be provided with the grip member 50, 600 700, 800, etc., such as being integrated into one of the components thereof. Optionally, the electrical device 300 may be removable from the grip member.

The electrical device 300 includes one or more sensors 301, such as a gyroscope 302 and/or accelerometer 303, in communication with a processor device 304, which may provide one or more signals to a suitable indicator 306 for visual, audible, and/or tactile indication. The functional elements operate to provide the benefits described above. Each block of the electrical device 300 is discussed separately below. However, they may operate together as indicated.

Power Supply

The power supply 308 may be by a non-rechargeable battery or a rechargeable battery. Included with the battery may be a charging device that will control the charging of the battery ensuring it does not get damaged during the charging process. A small plug on the outside of the case may be provided to allow for a connection, such as a micro USB or USB-C connection for charging purposes. There may also be the possibility of having a voltage regulator that will keep the voltage supply constant from the battery to the microprocessor, sensors, and other components. The non-rechargeable battery would have a sliding compartment to insert a battery into the electronics compartment.

LED

One or more LEDs 310 may be used to indicate to the user different battery status, such as low voltage, charging, fully charged, on/off, etc.

User Input Interface

The user input interface 312 enables the user to input information into the processor. One example of data input is whether the user wants the electric device turned on or activated. Another input could be which setting the user is selecting, for example, wrist-cock mode (gyroscope function), shot distance mode (accelerometer function), or both. Another input may include settings for beginner, intermediate, or advanced, which could have different threshold settings associated with each. In shot distance mode, the user could input could allow the user to select desired estimated shot distance ranges (e.g., 1-5 yards, 5-10 yards, 10-20 yards, 20-30 yards, or 30 or more yards). In addition, the user could select the type of club being used (e.g., pitching wedge, gap wedge, sand wedge, and lob wedge), or the club face angle (e.g., 47-53 degrees, 50-54 degrees, 54-58 degrees, and 58-62 degrees), so as to enable the device to more accurately estimate shot distance.

Microprocessor

The processor 304 can be a variety of various processors including dual microprocessor and other multi-processor architectures. The processor 304 may store one or more threshold settings for each of the sensors 301 and interpret the data coming from them. For example, both the gyroscope 302 and accelerometer 303 may communicate an output signal to the processor 304. The signals may be passed though amplifiers or filters before reaching the microprocessor if required. Depending on the setting the user selects, the microprocessor may monitor and evaluate the change in signals from the respective sensors 301. In accordance therewith, the microprocessor 304 may communicate a signal to an indicator 306 to alert the user whether there has been a change in a signal from the one or more of the sensors, which indicates a state of the sensor 301 and whether a threshold level has been reached or exceeded. The processor 304 stores the program and any algorithms that can control the electronic device 300.

It is generally understood that embodiments of the subject matter described in this disclosure can be implemented in combination with digital electronic circuitry, controllers, processors, computer software, firmware, and/or hardware. For example, embodiments may be implemented that use one or more modules of computer program with instructions encoded on a non-transitory computer-readable medium for execution by, or to control the operation of, data processing apparatus. The operations may include physical manipulations of physical quantities. Usually, though not necessarily, the physical quantities take the form of electrical or magnetic signals capable of being stored, transferred, combined, compared, and otherwise manipulated in a logic and the like.

It will be appreciated that the processes may be implemented using various programming approaches like machine language, procedural, object oriented or artificial intelligence techniques. In one example, methodologies are implemented as processor executable instructions or operations provided on a computer-readable medium. Thus, in one example, a computer-readable medium may store processor executable instructions operable to perform a method. The computer-readable medium may be a hard-drive, a machine-readable storage device, a memory device, or a combination of one or more of the foregoing. The controller may include all apparatus, devices, and machines for processing data, including by way of example a programmable processor, a computer, or multiple processors or computers.

A controller may include, in addition to hardware, code that creates an execution environment for the computer program in question. The computer program (also referred to as software or code), may be deployed in any form, including as a stand-alone program or as a module, component, subroutine, or other unit suitable for use in a computing environment. The computer program may be deployed to be executed on one computer or on multiple computers that are located at one site or distributed across multiple sites and interconnected by a communication network. The processor may include all apparatus, devices, and machines suitable for the execution of a computer program, which may include, by way of example, both general and special purpose microprocessors, and any one or more processors of any kind of digital computer. Generally, the processor will receive instructions and data from a read-only memory or a random-access memory or both. The computer may include, or be operatively coupled to receive data from or transfer data to, or both, one or more mass storage devices for storing data. Devices suitable for storing computer program instructions and data include all forms of non-volatile memory, media and memory devices, including by way of example semiconductor memory devices. The processor and the memory can be supplemented by, or incorporated in, special purpose logic circuitry.

Indicator

The indicator 306 is a device that is capable of emitting an audible, visual or tactile (e.g., vibration) signal to the user, for example, when the unit has crossed a certain threshold and the processor sends a signal to it.

Gyroscope

The gyroscope 302 is a sensor 301 configured to detect rotations along at least one axis in a well-known manner. For example, there may be a yaw, roll and pitch axis measured by the gyroscope 302. The gyroscope 302 may be a single axis gyroscope whose principle measuring axis is parallel to the shaft 20 of the club. The primary purpose of the gyroscope 302 is to measure whether or not the electronic device 300 and/or grip member 150 has made any kind of rotation around the principal axis of the golf club shaft 20. When the gyroscope 302 is initially powered on or enabled it shall be at an at rest state. Once rotation is detected around one of the axes, this at rest status shall change to reflect the angular velocity of the rotation. This change (delta) from the at-rest state can be used to determine how much rotation occurred, and this signal is sent to the microprocessor for analysis. If the processor 304 determines that the device has rotated beyond a certain threshold of tolerance for movement, either set by the user—i.e., beginner, intermediate, or advanced; or set by the manufacturer in a predetermined range, the processor 304 will signal an indicator 306 (e.g., visual, audible, and/or vibrational) to alert the user that the threshold has been passed. In this manner, the device 300 will indicate when the user has cocked their wrists past a certain limit during the backswing. Such an alert provides feedback to the user that enables them to build muscle memory during training or playing to make a shot that does or does not trigger the alert (depending on the setting). Such a function is particularly beneficial for chip shots or pitch shots having a relatively short distance (e.g., less than about 50 yards).

Figure 46:
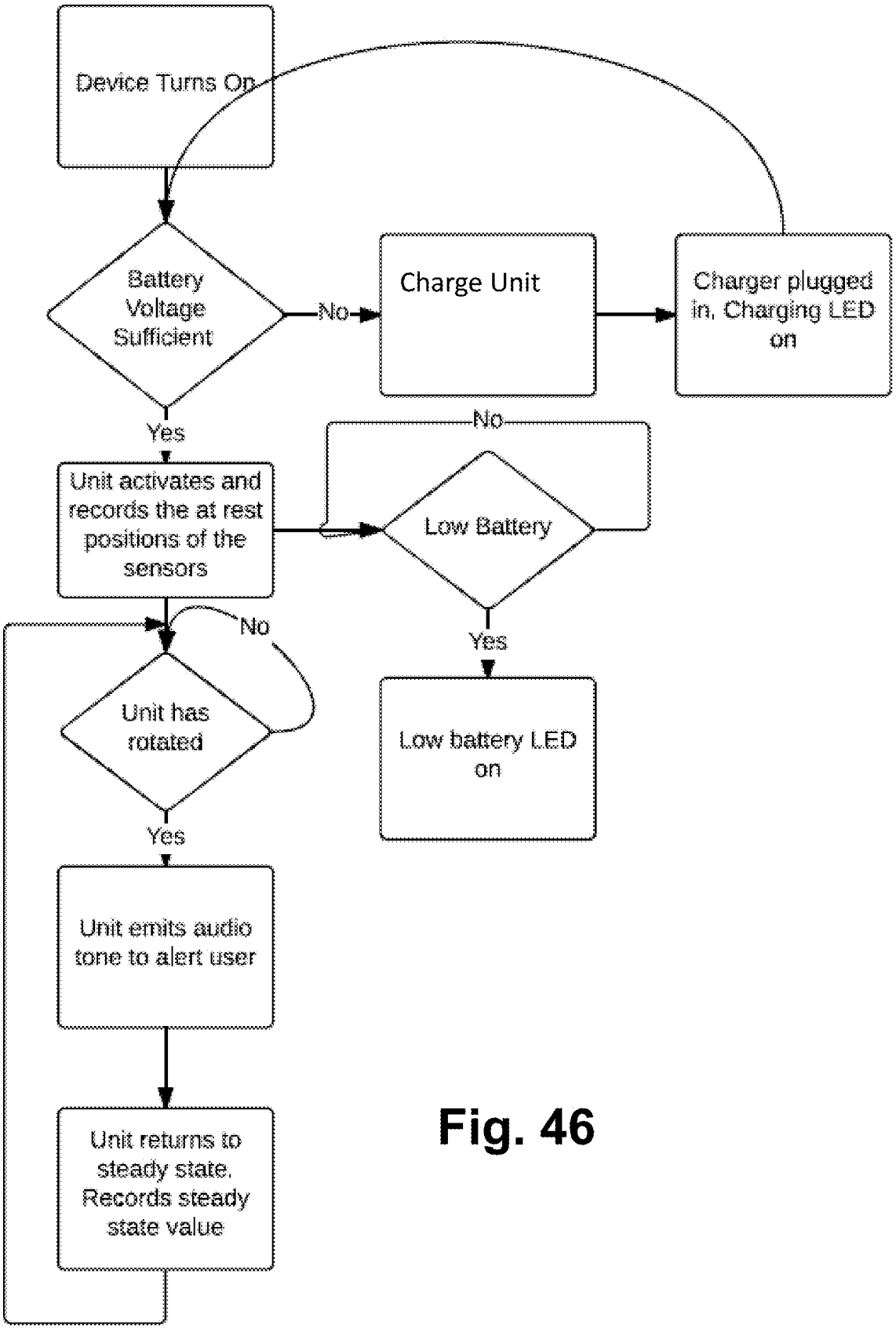
FIG. 46 shows a flow diagram illustrating operation of the electronic device in a wrist-cock mode using a gyroscope.

FIG. 46 illustrates a flow diagram of a wrist-cock mode (gyroscope function). More generally, the basic steps for the wrist-cock function are as follows. (1) The user turns on the device 300 when it is already on the shaft of the club and the user is addressing the ball. (2) The gyroscope 302 begins to measure the rotation of the device 300 about the principal axis corresponding to the shaft of the club. (3) The user then begins their backswing. If during the backswing the user moves/cocks their wrist rotating the device 300 more than a certain threshold amount (either selected by the user or a predetermined amount), the gyroscope will detect this and via the processor will signal the indicator that will alert the use of their wrist movement. The amount of movement may be very small, most probably just enough to compensate for any noise that would occur from the gyroscope.

Accelerometer

The accelerometer 303 is a sensor 301 that may be utilized either when at rest or in motion. The use of an accelerometer 303 may be used in conjunction with the gyroscope 302 for added accuracy or for additional features. The accelerometer 303 measures acceleration of the unit 300 and/or 150 along three axes: x, y, and z forming a three dimension space. When the accelerometer 303 is powered and at a steady state it will output different values for each of the three axis depending on how it is oriented compared to gravity. This can be used to evaluate position and movement from this original position. If the accelerometer 303 is not in a steady state (i.e., in motion) it will measure the acceleration that is acting on it. In this manner, the accelerometer can be used to calculate speed and distance traveled.

The signals from the accelerometer 303 will be sent to the processor 304 for analysis. Based on the values corresponding to speed and/or distance received from the accelerometer, the processor 304 can make calculations assuming the same speed and distance will occur during the downswing to strike the ball, and based on these assumptions (among other considerations, such as club and ball weight, club face angle, coefficients of restitution, and the like) the processor can calculate an estimated shot distance. If the calculation for shot distance reaches the selected threshold shot distance range, then the processor 304 will communicate a signal to the indicator 306 (e.g., visual, audible, and/or vibrational) to alert the user that the threshold has been reached (i.e., that the user has brought the club/device back fast enough and/or far enough to be able to hit the ball the selected range). The threshold positions may be set by the user (e.g., 1-5 yards, 5-10 yards, 10-20 yards, etc.). In addition, the user may select the type of club being used (e.g., pitching wedge, gap wedge, sand wedge, or lob wedge), or the club face angle (e.g., 47-53 degrees, 50-54 degrees, 54-58 degrees, or 58-62 degrees). In this manner, the device 300 can indicate whether the threshold range of e.g., speed/distance during the backswing has been reached for providing the desired assumed speed during the downswing to acquire the desired estimated distance of the shot depending on the club selected. Such a function is particularly beneficial for chip shots or pitch shots having a relatively short distance (e.g., less than about 50 yards).

Figure 47:
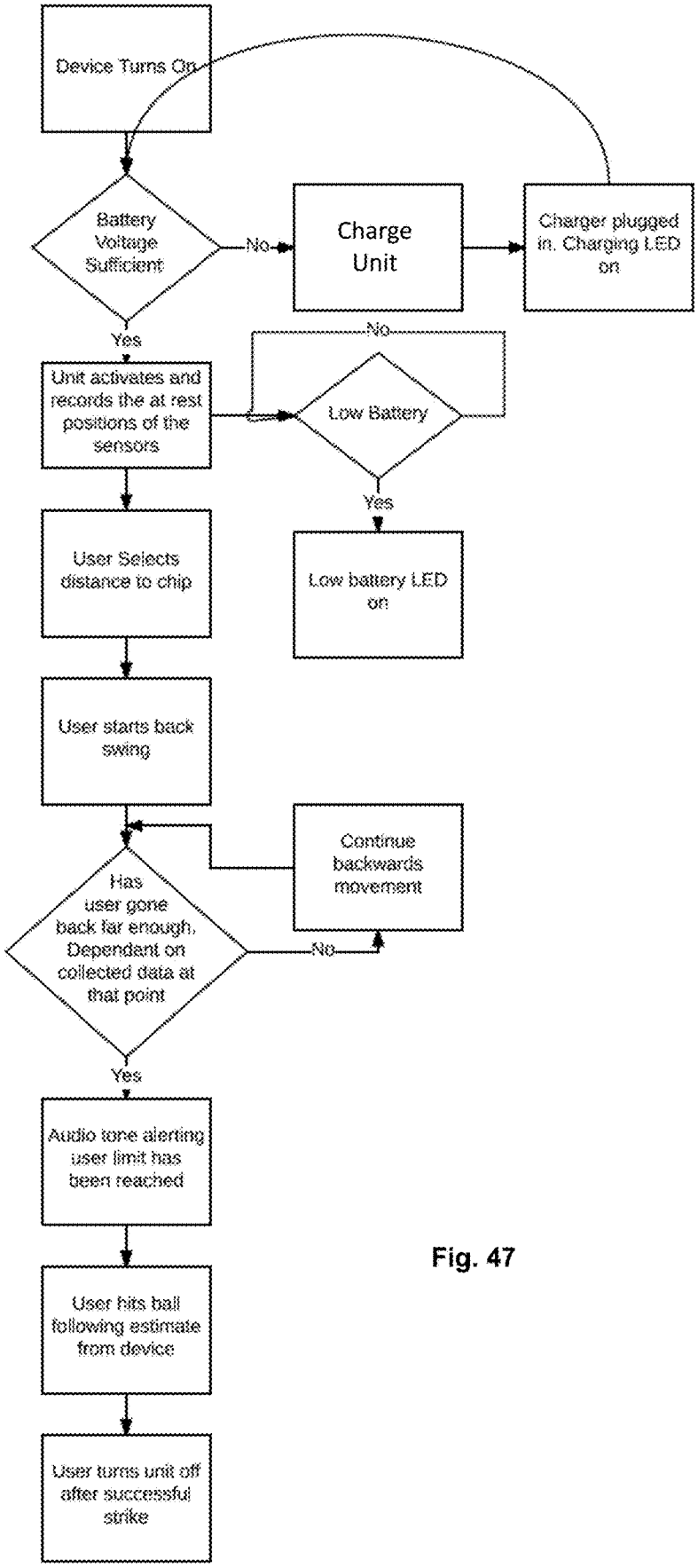
FIG. 47 shows a flow diagram illustration operation of the electronic device in a shot distance mode using an accelerometer.

FIG. 47 illustrates a flow diagram for the shot distance mode (accelerometer function). More generally, the basic steps for the shot distance function are as follows. (1) The user would activate the device 300 and select a range they would want to hit (e.g., 1-10 yards, 10-20 yards, etc.). (2) The user may select the type of club being used (e.g., pitching wedge, gap wedge, sand wedge, or lob wedge), or the club face angle (e.g., 47-53 degrees, 50-54 degrees, 54-58 degrees, or 58-62 degrees). (3) Optionally, the device 300 would still check for wrist rotation during this time using the gyroscope function. (4) The accelerometer 303 begins to measure the acceleration of the device 300 about the axes x, y and z in three-dimensional space. (5) Optionally, the gyroscope may be used in conjunction with the accelerometer to provide more accurate measuring results while still measuring for wrist-cock. (6) The user would begin their backswing a certain distance until an indication is provided (e.g., audible, visual and/or vibration). Preferably, the indication will be a different indication than the indication for indicating wrist-cock. This backswing distance will be calculated depending on the acceleration during the backswing and other data collected from the accelerometer 303, along with inputs from the user and other built-in assumptions. Once the indicator 306 alerts the user, the user shall downswing their club at about the same speed. The user may use the device 300 to hit the ball after being alerted, or the user may use the device 300 repetitively to build a tempo for the shot to be taken, so as to build muscle memory into taking the actual shot.

Figure 48:
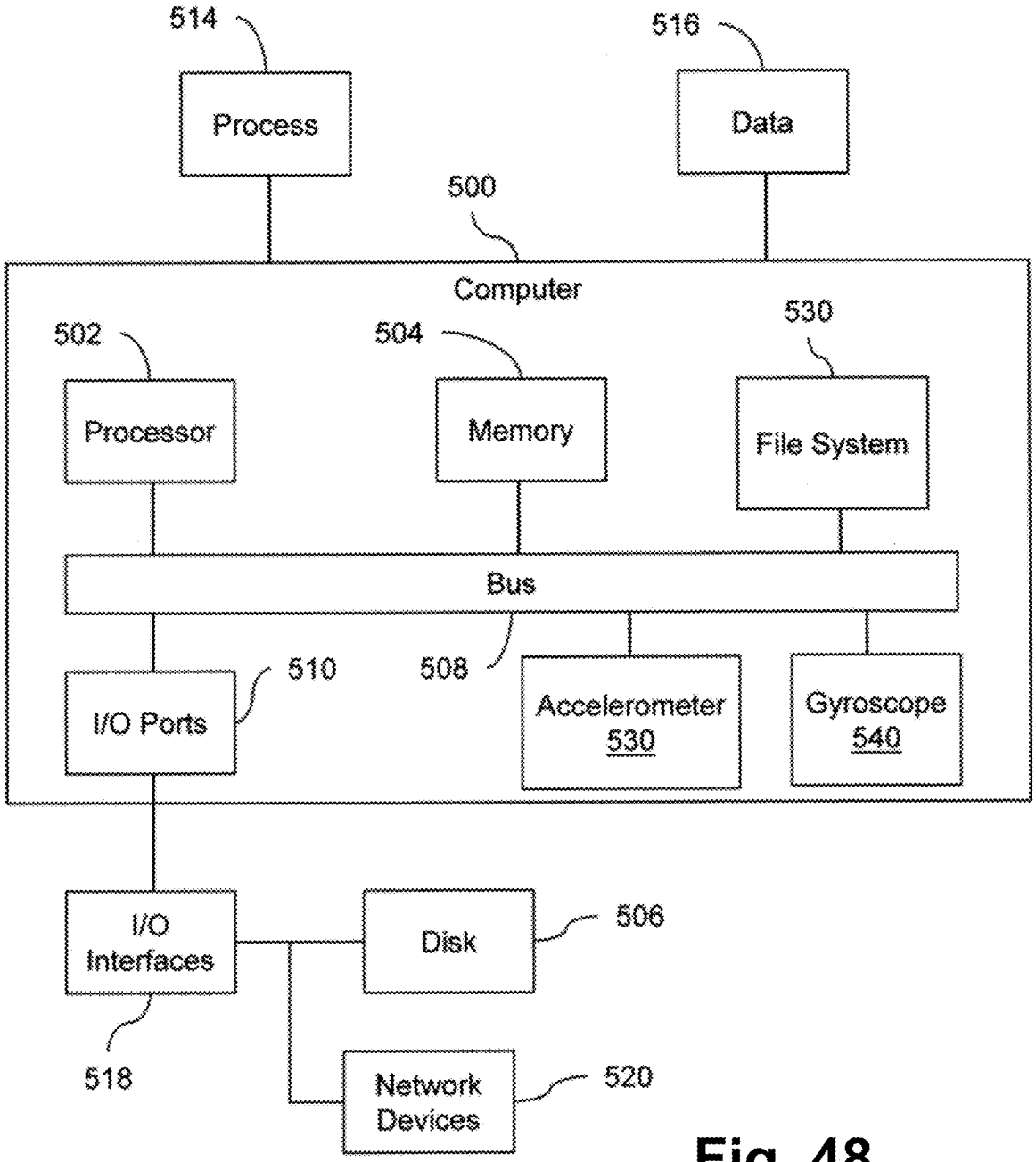
FIG. 48 shows a block diagram illustrating modules or functional elements of a computer including sensors and a processor for an electronic device for an exemplary golf swing playing aid device according to an embodiment.

Turning to FIG. 48, the electronic device 300 may optionally include or be a part of a computer 500 that includes a processor 502, a memory 504, and I/O Ports 510 operably connected by a bus 508. In one embodiment, the computer 500 of FIG. 20 may correspond with a computer for operating the user interface assembly 312 described above. The computer 500 may communicate with another computer or device, such as a smartphone, or the like.

In one example, the computer 500 may include a communication module 530 configured to receive or send signals from or to a location remote from a location of the device 300, for example, sending data to and from a smartphone. In one example, the computer 500 may include an accelerometer module 530 (which may correspond with accelerometer 303) for communicating with the processor 502 (which may correspond with processor 304) which may provide a signal to an indicator (which may correspond with indicator 306), as described above. Optionally or additionally, the computer 500 may include a gyroscope module 540 (which may correspond with gyroscope 302) for communicating with the processor 502 and providing an indication to the indicator (not shown), as described above. The processor 502 can be a variety of various processors including dual microprocessor and other multi-processor architectures. The memory 504 can include volatile memory or non-volatile memory. The non-volatile memory can include, but is not limited to, ROM, PROM, EPROM, EEPROM, and the like. Volatile memory can include, for example, RAM, synchronous RAM (SRAM), dynamic RAM (DRAM), synchronous DRAM (SDRAM), double data rate SDRAM (DDR SDRAM), and direct RAM bus RAM (DRRAM).

A disk 506 may be operably connected to the computer 500 via, for example, an I/O Interfaces (e.g., card, device) 518 and an I/O Ports 510. The disk 506 can include, but is not limited to, devices like a magnetic disk drive, a solid state disk drive, a floppy disk drive, a tape drive, a Zip drive, a flash memory card, or a memory stick. Furthermore, the disk 506 can include or communicate with optical drives like a CD-ROM, a CD recordable drive (CD-R drive), a CD rewriteable drive (CD-RW drive), or a digital video ROM drive (DVD ROM). The memory 504 can store processes 514 or data 516, for example. The disk 506 or memory 504 can store an operating system that controls and allocates resources of the computer 500.

The bus 508 can be a single internal bus interconnect architecture or other bus or mesh architectures. While a single bus is illustrated, it is to be appreciated that computer 500 may communicate with various devices, logics, and peripherals using other busses that are not illustrated (e.g., PCIE, SATA, Infiniband, 1394, USB, Ethernet). The bus 508 can be of a variety of types including, but not limited to, a memory bus or memory controller, a peripheral bus or external bus, a crossbar switch, or a local bus. The local bus can be of varieties including, but not limited to, an industrial standard architecture (ISA) bus, a microchannel architecture (MCA) bus, an extended ISA (EISA) bus, a peripheral component interconnect (PCI) bus, a universal serial (USB) bus, and a small computer systems interface (SCSI) bus.

The computer 500 may interact with input/output devices via I/O Interfaces 518 and I/O Ports 510. Input/output devices can include, but are not limited to, a display, a speaker, an indicator, another computer (e.g., smartphone, etc.), a keyboard or switch, disk 506, network devices 520, and the like. The I/O Ports 510 can include but are not limited to, serial ports, parallel ports, and USB ports. The computer 500 can operate in a network environment and thus may be connected to network devices 520 via the I/O Interfaces 518, or the I/O Ports 510. Through the network devices 520, the computer 500 may interact with a network. Through the network, the computer 500 may be logically connected to remote computers or devices, such as smartphones and the like. The networks with which the computer 500 may interact include, but are not limited to, a local area network (LAN), a wide area network (WAN), and other networks. The network devices 520 can connect to LAN technologies including, but not limited to, fiber distributed data interface (FDDI), copper distributed data interface (CDDI), Ethernet (IEEE 802.3), token ring (IEEE 802.5), wireless computer communication (IEEE 802.11), Bluetooth (IEEE 802.15.1), Zigbee (IEEE 802.15.4) and the like. Similarly, the network devices 520 can connect to WAN technologies including, but not limited to, point to point links, circuit switching networks like integrated services digital networks (ISDN), packet switching networks, and digital subscriber lines (DSL). While individual network types are described, it is to be appreciated that communications via, over, or through a network may include combinations and mixtures of communications.

A golf playing aid device has been described and shown in the various exemplary embodiments above. It is understood that the principles and aspects described above may be applicable to other playing or training aids where it is desirable to provide a proper swing and committing the mechanics of such a swing to muscle memory, such as for baseball, cricket, lacrosse, hockey, and the like. The playing aid device may include one or more of the following features, alone or in any combination:

The playing aid device may enable the average golfer to use this playing tool during a regulation round of golf by affixing it to any of their own golf clubs at the point-of-play.

The device may promote a more perfect and repeatable full and short game golf swing.

The device may promote the stretching of one's muscles to increase flexibility with the intent of increasing the speed at which one could swing the club.

The device may enable the average golfer positions their hands in such a fashion to accomplish a more accurate and repeatable golf swing.

The device may be used with a throwing motion, which helps increase distance by increasing speed and acceleration, as well as accuracy.

Nub(s) on the outside of the device, which may be positioned between the index finger and middle finger of the lower (i.e. dominant) club-gripping hand, which simulates the hand positioning for throwing a baseball so the golfer can use a throwing motion to direct the hands at the golf ball to be hit on the downswing.

A ball-shaped form, such as a bulbous or generally spherical or hemispherical form, of at least a portion of the device that is adapted to be grasped by the user serves as a more intuitive way for the golfer to conceptualize and practice "throwing" the ball-shaped form at the ball on the ground during the golf swing, or at the hole with an underhand motion during chip shots.

This shape, size and/or weight of the playing aid device serve as embodied cognition to remind the golfer they will be throwing this ball shaped form in a direct line at the back inside quadrant of the actual ball they have in play.

The interior of the device may have one or more unique features. For example, evenly spaced grooves which reduce the surface area of the device that is in contact with the club and thus reduce the friction between the two objects. This increases the speed with which the golfer can swing the club.

The opening of the device on the club head facing end may be tapered so that the device may be tightly affixed to the grip while the device is not in use. Alternatively or additionally, locking mechanisms may be used to lock the device onto the grip.

There may be an opening or slit running the entire length of the device from opening to opening, which allows it to be attached to and removed from any of the golfer's own clubs.

The device may be designed for use by sliding up and down the shaft. The device may also have locking mechanisms for being tightly affixed to the grip for use when playing with the club to prevent the device moving relative to the club.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A golf swing playing aid device adapted for use on a conventional golf club having a handle, an impact head and a shaft, the golf swing playing aid device comprising:

a grip member having an outer portion and an inner portion;

the outer portion having a portion with a ball-shaped form that is adapted to be gripped like a ball in a hand of a user; and the inner portion forming an internal passage extending along a longitudinal axis between a lower portion and an upper portion of the grip member for enabling insertion of the golf club through the internal passage;

wherein the grip member is configured to be mountable on or removable from the golf club, and when mounted on the golf club, the grip member is usable in a sliding mode or in a static mode;

wherein when in the sliding mode, the inner portion is configured to slide along the shaft of the golf club such that when the grip member is gripped by a lower hand of the user during a backswing, the grip member slides down the shaft toward the head, whereby when grasping the handle with an upper hand and the grip member with the lower hand, the lower hand and the upper hand of the user can separate progressively during the backswing and then progressively return back into proximity during a downswing and follow-through of a golf swing to thereby promote ingraining a higher quality and more repeatable golf swing into muscle memory; and wherein the ball-shaped form of the outer portion enables the user to conceptualize throwing the grip member as a ball toward a golf ball on the ground during the downswing, thereby enhancing the quality and repeatability of the golf swing of the user;

wherein when in the static mode, the grip member is configured to grippingly engage the handle of the golf club in such a way to secure the grip member on the golf club;

the device having a locking mechanism including a plurality of locking elements circumferentially disposed about the longitudinal axis, and a locking sleeve that is actuatable to transition the locking elements between (i) a lock state corresponding with the static mode, in which the locking elements grip against the handle and restrict movement of the grip member relative to the handle, and (ii) a release state corresponding to the sliding mode, in which the locking elements sufficiently release from the handle to enable the grip member to move relative to the handle and slide along the shaft.

2. The golf swing playing aid device according to claim 1, wherein a majority of the outer portion is in the ball-shaped form.

3. The golf swing playing aid device according to claim 1, wherein the outer portion has an indented portion adapted for placement of a thumb of the user to enable proper placement of hands on club and squaring of club face in respect to the golf ball on the ground; and wherein a lower U-shaped contour of the indented portion is pointed in a direction of the longitudinal axis of the grip member such that the thumb of the user points in the direction of the longitudinal axis when gripping the grip member.

4. The golf swing playing aid device according to claim 1, wherein the outer portion includes a rubber or elastomeric material; and wherein the inner portion includes a plastic material that resists deformation when acted upon by a force exerted by the user during the golf swing and that facilitates sliding of the grip member along the shaft.

5. The golf swing playing aid device according to claim 1, wherein the grip member includes an axial slot that extends longitudinally along the length of the device from one axial end opening to an opposite axial end opening, in which the axial slot extends radially to open through the inner portion and to open through the outer portion to enable the device to be attached to or removed from the golf club via the axial slot.

6. The golf swing playing aid device according to claim 1, wherein the locking mechanism provides sufficient adherence to the handle that it restricts or prevents the device from spinning or turning during actual full golf swings so as not to alter the flight of the shot toward the intended target.

7. The golf swing playing aid device according to claim 1, wherein the plurality of locking elements include resilient locking elements that are formed from respective portions of the inner portion, the resilient locking elements being biased radially outwardly toward respective radially outward release positions, and being movable radially inwardly toward respective radially inward lock positions; and wherein the locking sleeve is actuatable to cause relative axial movement between the locking sleeve and the resilient locking elements, the locking sleeve being configured to cooperate with the resilient locking elements such that when the locking sleeve is at a first axial position the resilient locking elements are biased to the respective radially outward release positions corresponding with the release state, and when the locking sleeve is moved to a second axial position, the locking sleeve interfaces against the resilient locking elements via respective radially tapered interfaces to force the resilient locking elements to the respective radially inner lock positions corresponding with the lock state.

8. The golf swing playing aid device according to claim 1, wherein the inner portion of the device is a discrete sleeve that is insertable into the outer portion.

9. The golf swing playing aid device according to claim 8, wherein an outer surface of the inner portion includes anti-rotation elements that are configured to cooperate with corresponding anti-rotation elements on an inner surface of the outer portion.

10. The golf swing playing aid device according to claim 1, wherein the inner portion includes evenly spaced grooves and/or ridges that extend longitudinally along the length of the device for engaging the shaft of the club and/or the handle.

11. The golf swing playing aid device according to claim 1, further including an electronic device;

wherein the electronic device is configured to determine and indicate whether the user's wrist has hinged during the backswing, so as to alert the user of such wrist hinge; and/or wherein the electronic device is configured to determine and indicate the distance of a shot by measuring the backswing, so as to alert the golfer that the distance of the shot may be achieved; and/or wherein the electronic device includes a gyroscope configured for measuring rotation of the device about one or more axes and for communicating signals to a processor for determining whether a measured rotation has reached or exceeded a threshold level; and/or wherein the electronic device includes an accelerometer configured for measuring acceleration of the device along one or more axes and for communicating signals to a processor for determining whether the measured acceleration has reached or exceeded a threshold level.

12. A golf swing playing aid device adapted for use on a conventional golf club having a handle, an impact head and a shaft, the golf swing playing aid device comprising:

a grip member having an outer portion and an inner portion;

the outer portion being adapted for being grasped in a hand of a user; and the inner portion forming an internal passage extending along a longitudinal axis between a lower portion and an upper portion of the grip member for enabling insertion of the golf club through the internal passage;

wherein the grip member is configured to be mountable on or removable from the golf club, and when mounted on the golf club, the grip member is usable in a sliding mode or in a static mode;

wherein when in the sliding mode, the inner portion is configured to slide along the shaft of the golf club such that when the grip member is gripped by a lower hand of the user during a backswing, the grip member slides down the shaft toward the head, whereby when grasping the handle with an upper hand and the grip member with the lower hand, the lower hand and the upper hand of the user can separate progressively during the backswing and then progressively return back into proximity during a downswing and follow-through of a golf swing to thereby promote ingraining a higher quality and more repeatable golf swing into muscle memory; and wherein when in the static mode, the grip member is configured to grippingly engage the handle of the golf club in such a way to secure the grip member on the golf club;

the device having a locking mechanism including a plurality of locking elements circumferentially disposed about the longitudinal axis, and a locking sleeve that is actuatable to transition the locking elements between (i) a lock state corresponding with the static mode, in which the locking elements grip against the handle and restrict movement of the grip member relative to the handle, and (ii) a release state corresponding to the sliding mode, in which the locking elements sufficiently release from the handle to enable the grip member to move relative to the handle and slide along the shaft.

13. The golf swing playing aid device according to claim 12, wherein the locking sleeve includes a threaded portion that threadedly interacts with another threaded portion of the device to actuate the locking mechanism, the locking sleeve being threadedly rotatable relative to the locking elements about the longitudinal axis to cause relative axial movement between the locking sleeve and the locking elements, and wherein threaded rotation of the locking sleeve to actuate the locking mechanism causes forcible movement of the locking elements from a radially outer position corresponding with the release state to a radially inner position corresponding with the lock state.

14. The golf swing playing aid device according to claim 12, wherein the locking sleeve is actuatable to cause relative axial movement between the locking sleeve and the locking elements, and wherein, in response to the relative axial movement between the locking sleeve and the locking elements, the locking elements are configured to move between (i) a radially outer position corresponding with the release state, and (ii) a radially inner position corresponding with the lock state.

15. The golf swing playing aid device according to claim 14, wherein respective portions of the locking sleeve interact with respective portions of the locking elements via respective radially tapered interfaces, such that when the locking sleeve is at a first axial position the locking elements are at respective radially outer positions corresponding with the release state, and when the locking sleeve is at a second axial position the locking elements are at respective radially inner positions corresponding with the lock state.

16. The golf swing playing aid device according to claim 14, wherein the locking elements are formed as flexible fingers that are biased toward the radially outer position, and wherein the locking sleeve is configured to cooperate with the flexible fingers such that (i) when the locking sleeve is at a first axial position relative to the flexible fingers, the flexible fingers are at the respective radially outer positions corresponding with the release state, and (ii) when the locking sleeve is moved to a second axial position relative to the flexible fingers, the locking sleeve interfaces against the flexible fingers to force the flexible fingers to the respective radially inner positions corresponding with the lock state.

17. The golf swing playing aid device according to claim 16, wherein the flexible fingers form at least a portion of the inner portion of the device and extend longitudinally to terminate at respective free ends of the flexible fingers, wherein the respective free ends are biased radially outwardly, and wherein the respective free ends are opposite respective first end portions of the flexible fingers, the respective first end portions being toward a top of the device and the respective free ends being toward a bottom of the device.

18. The golf swing playing aid device according to claim 12, wherein the locking elements include longitudinally extending fingers that are circumferentially spaced apart about the longitudinal axis, the longitudinally extending fingers forming at least a portion of the inner portion of the device which engage the shaft of the golf club when the device is in the sliding mode, and wherein the inner portion further includes axially extending grooves and/or radially extending protuberances.

19. A golf swing playing aid device for use with a golf club, the device comprising:

a grip having an outer surface adapted for being grasped in a hand of a user, and an inner surface radially inward of the outer surface, the inner surface forming at least a portion of an internal passage that extends along a longitudinal axis between a lower portion and an upper portion of the grip for mounting the grip on the golf club; and a lock mechanism that cooperates with the grip for securing the grip on the golf club when the lock mechanism is in a lock state, and for enabling the grip to slide along the golf club when the lock mechanism is in a release state, the lock mechanism including:

a plurality of flexible fingers extending axially from the grip in a longitudinal direction and being circumferentially disposed about the longitudinal axis, the plurality of flexible fingers being biased toward respective radially outward release positions corresponding with the release state, and the plurality of flexible fingers being radially inwardly movable toward respective radially inward lock positions corresponding with the lock state; and a lock sleeve disposed radially outwardly of the plurality of flexible fingers, the lock sleeve being axially movable relative to the plurality of fingers between a first axial position corresponding with the release state, and a second axial position corresponding with the lock state;

wherein the lock mechanism is transitional between the release and lock states in response to movement of the lock sleeve between the first and second axial positions, such that (i) when the lock sleeve is at the first axial position, the lock sleeve cooperates with the plurality of flexible fingers to permit the plurality of flexible fingers to bias radially outwardly to the respective radially outward release positions, and (ii) when the lock sleeve is moved to the second axial position, the lock sleeve interfaces against the respective flexible fingers via respective radially tapered interfaces to thereby force the plurality of flexible fingers radially inwardly to the respective radially inward lock positions.

20. The golf swing playing aid device according to claim 19, wherein:

the grip has an axial slot that extends longitudinally along a length of the grip, in which the axial slot extends axially from one end of the grip to an opposite end of the grip, and extends radially to open through the inner surface and to open through the outer surface to enable the grip to be mounted on or removed from the golf club via the axial slot, the outer surface having a ball-shaped form; and the lock sleeve includes a threaded portion that threadedly interacts with another threaded portion of the device to transition the lock mechanism between the lock and release states, the lock sleeve being threadedly rotatable relative to the plurality of flexible fingers about the longitudinal axis, such that (i) when the lock sleeve is rotatably threaded toward the second axial position, the lock sleeve interfaces against the respective flexible fingers via the respective radially tapered interfaces to force the plurality of flexible fingers radially inward to the respective radially inward lock positions to thereby secure the grip on the golf club, wherein the respective radially tapered interfaces are formed by respective radially tapered surfaces of the flexible fingers and/or are formed by one or more respective radially tapered surfaces of the lock sleeve; and (ii) when the lock sleeve is rotatably threaded toward the first axial position, the lock sleeve permits the plurality of flexible fingers to bias radially outwardly to the respective radially outward release positions to thereby enable the grip and lock mechanism to move along the golf club.

* * * * *